US006506265B2

(12) United States Patent
Yamamoto et al.

(10) Patent No.: US 6,506,265 B2
(45) Date of Patent: Jan. 14, 2003

(54) R-FE-B BASE PERMANENT MAGNET MATERIALS

(75) Inventors: Kenji Yamamoto, Takefu (JP); Koro Tatami, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/879,068

(22) Filed: Jun. 13, 2001

(65) Prior Publication Data

US 2002/0007875 A1 Jan. 24, 2002

(30) Foreign Application Priority Data

Jun. 13, 2000 (JP) ..... 2000-176595

(51) Int. Cl.[7] ..... H01F 1/057
(52) U.S. Cl. ..... 148/302; 148/302; 75/244
(58) Field of Search ..... 148/302, 303; 420/83, 121; 75/244

(56) References Cited

U.S. PATENT DOCUMENTS 4,895,607 A * 1/1990 Yang et al. ..... 148/104
5,194,099 A * 3/1993 Esper et al. ..... 148/302
5,858,123 A * 1/1999 Uchida et al. ..... 148/302
6,159,308 A * 12/2000 Uchida et al. ..... 148/302

FOREIGN PATENT DOCUMENTS

JP 2000-234151 12/1999

OTHER PUBLICATIONS

Abstract of Japanese Patent JP2000234151, Aug. 24, 2000.

* cited by examiner

*Primary Examiner*—John Sheehan
(74) *Attorney, Agent, or Firm*—Millen, White, Zelano & Branigan, P.C.

(57) ABSTRACT

A R—Fe—B base permanent magnet material is composed of a R—Fe—B magnet alloy which contains 87.5–97.5 vol % of a $Fe_{14}R_2B_1$ primary phase and 0.1–3 vol % of a rare earth oxide or a rare earth and transition metal oxide. The alloy contains as a major component in its metal structure a compound selected from among zirconium-boron compounds, niobium-boron compounds and hafnium-boron compounds. The compound has an average grain size of at most 5 μm and is uniformly distributed within the alloy such that the maximum interval between neighboring grains of the compound is at most 50 μm. Rare-earth permanent magnet materials of this composition and structure have excellent magnetic properties.

20 Claims, 12 Drawing Sheets

R-FE-B BASE PERMANENT MAGNET MATERIALS

BACKGROUND OF THE INVENTION

1. Field of the Invention

The present invention relates to R—Fe—B base permanent magnet materials.

2. Prior Art

Rare-earth permanent magnets are commonly used in electrical and electronic equipment on account of their excellent magnetic properties and low cost. Lately, a need has been felt for the development of higher-performance magnets of this type. One family of rare-earth permanent magnets, namely, rare earth-iron-boron (R—Fe—B) magnets, has lower starting material costs than rare earth-cobalt (R—Co) magnets because the key element neodymium exists in more plenty than samarium and the content of cobalt is low. This family of magnets also has much better magnetic properties than rare-earth cobalt magnets, making them excellent as permanent magnet materials.

Not surprisingly, there exists a desire for further increases in the magnetic properties of such R—Fe—B permanent magnets. Increasing the magnetic properties of R—Fe—B permanent magnets will require a reduction in the oxygen concentration within the constituent alloy. However, lowering the oxygen concentration within the alloy tends to result in abnormal grain growth during the sintering process, giving a magnet having a high residual flux density (Br), but an inadequate maximum energy product ($(BH)_{max}$), and thus a hysteresis curve with a poor squareness.

SUMMARY OF THE INVENTION

It is therefore an object of the invention to provide high-performance R—Fe—B base permanent magnet materials that are comprised of alloys having lowered oxygen concentrations yet exhibit little abnormal grain growth.

We have succeeded in holding down grain growth within neodymium-based magnetic alloys produced for the most part in low-oxygen processes by uniformly dispersing and precipitating a finely divided zirconium compound, niobium compound or hafnium compound in a cobalt, aluminum and copper-containing R—Fe—B permanent magnet which contains also zirconium, niobium or hafnium, so as to obtain sintered permanent magnet materials with greatly improved magnetic properties and a much broader sintering temperature range.

More specifically, lowering the oxygen concentration within the alloy for a R—Fe—B permanent magnet tends to give rise to abnormal grain growth and restrict the range in the optimal sintering temperature, drastically reducing productivity. To overcome such problems, we tried adding trace amounts of new elements to the alloy.

As we described earlier in Japanese Patent Application Kokai No. 2000-234151, following extensive studies on the addition of new elements to copper-containing R—Fe—B permanent magnets and on the amounts of such addition, we found that the addition of a trace amount of zirconium can increase somewhat the residual magnetic flux density (Br) and can greatly increase the coercivity (iHc). Subsequently, upon endeavoring to lower the oxygen concentration in the production processes so as to further enhance the magnetic properties, we have discovered that the optimal sintering temperature range can be greatly expanded by inducing the fine and uniform precipitation of a zirconium-boron compound, a niobium-boron compound or a hafnium-boron compound within the magnet.

Accordingly, the present invention provides a R—Fe—B base permanent magnet material composed of a rare earth-iron-boron magnetic alloy which contains a $Fe_{14}R_2B_1$ primary phase in a volumetric proportion of 87.5 to 97.5% and a rare earth oxide or a rare earth and transition metal oxide in a volumetric proportion of 0.1 to 3%; wherein the alloy has a metal microstructure containing as a major component a compound selected from the group consisting of zirconium-boron compounds, niobium-boron compounds and hafnium-boron compounds, which compound has an average grain size of at most 5 $\mu$m and is uniformly distributed within the alloy such that the maximum interval between neighboring grains of the compound is at most 50 $\mu$m.

BRIEF DESCRIPTION OF THE DIAGRAMS

Figure 20A:
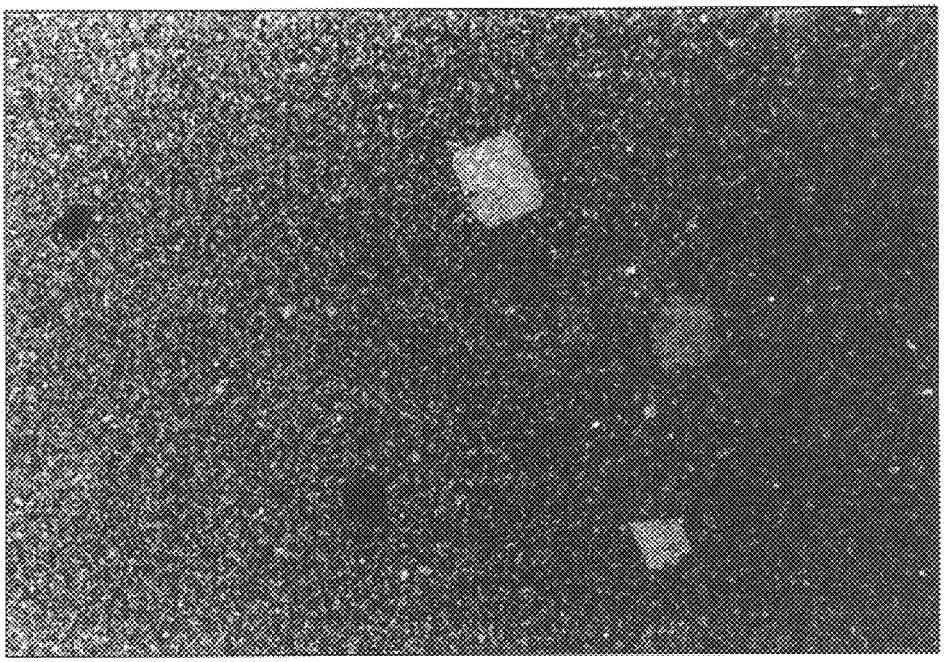
Figure 20B:
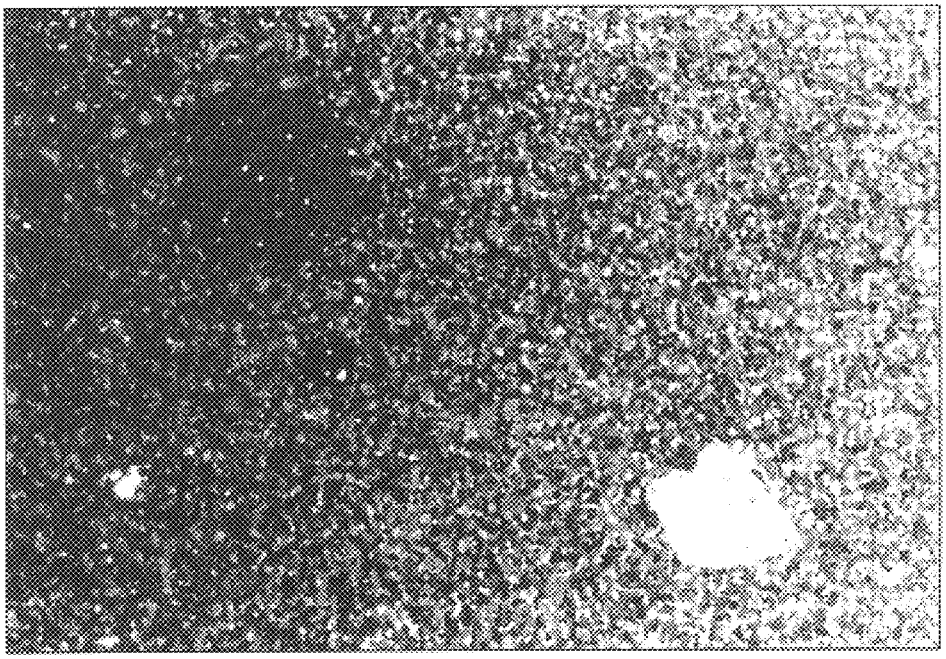

FIGS. 20(*a*) and (*b*) are photomicrographs showing giant, abnormally grown grains in prior-art rare-earth permanent magnet materials.

DETAILED DESCRIPTION OF THE INVENTION

R—Fe—B base magnet alloys are described in further detail. In the invention, R denotes one or two or more rare earth elements including the elements of atomic numbers 57 to 71 in the periodic table. The residual magnetic flux density and the energy product of R—Fe—B base magnetic alloys have been improved by increasing the volumetric proportion of the magnetic $Fe_{14}R_2B_1$ phase and decreasing in inverse proportion thereof the non-magnetic rare earth-rich grain boundary phase. The rare earth-rich phase serves to generate coercive force by cleaning the crystal grain boundaries of the $Fe_{14}R_2B_1$ main phase and removing grain boundary impurities and crystal defects. Hence, the rare earth-rich phase cannot be entirely removed from the magnetic alloy structure, regardless of how high this would make the flux density. Therefore, the key to further improvement of the magnetic properties is how to make the most effective use of a small amount of rare earth-rich phase for cleaning the grain boundaries, and thus achieve a high coercivity. The rare earth-rich phase is chemically active, and so it generally oxidizes easily in the course of processes such as milling and sintering, resulting in the formation of a rare earth oxide layer and consumption of the rare earth-rich phase. If the rare earth-rich phase, which has already been set to a low content in the alloy, reacts with oxygen during these production processes and is consumed as an oxide, the quality of the grain boundary structure cannot be fully enhanced, making it impossible in turn to attain the desired coercivity. Effective use of the minimal amount of rare earth-rich phase so as to obtain high-performance magnets having a high residual flux density and a high coercivity is possible only if measures are taken for preventing oxidation of the rare earth-rich phase throughout the production process. On the latest high-performance rare earth magnet production lines, each process, including milling, compacting and sintering, is carried out in a completely oxygen-free state so as to minimize oxides of the non-magnetic rare earth-rich phase and rare earth. The aim in so doing is to maximize the amount of the magnetic $Fe_{14}R_2B_1$ phase and enhance the magnetic properties of the magnet.

Unfortunately, the reduction in the content of the rare earth oxide phase achieved by preventing oxidation reactions in this way creates a new problem; namely, the formation of abnormally grown grains in the sintering process.

In the sintering process, densification proceeds via a sintering reaction within the finely divided powder. As particles of the pressed and compacted fine powder mutually bond at the sintering temperature, the pores diffused throughout the powder are displaced to the exterior, so that the powder fills the space within the compact, causing it to shrink. The rare earth-rich liquid phase present at this time is believed to promote a smooth sintering reaction.

In the last stage of the sintering process, the remaining pores are diffused out and excluded from the system, allowing the sintered compact to achieve its final density. As this final rise in density is taking place, each of the crystal grains for which sintering is complete begins to undergo Ostwald ripening. The grain boundaries of each crystal grain are themselves lattice defects. As ripening proceeds, the grain boundary length per unit volume decreases, reducing the interfacial energy at the grain boundaries and lowering the overall free energy of the sintered compact so that it becomes stable.

In domain wall nucleation-type magnets such as sintered rare earth magnets, smaller crystal grains generally result in a higher coercivity. Hence, a sintered compact having the smallest possible crystal grains is preferred. The reason why larger crystal grains result in a lower coercivity is thought to be the increased probability, as the crystals grow and the grain boundary surface area per grain increases, for the presence of major lattice defects capable of generating domain walls in a low magnetic field.

It is predicted that the coercivity of a rare earth magnet will increase as the crystal grain becomes smaller, down to a single domain grain size of about 0.3 $\mu$m for rare earth magnets, at which point the influence of lattice defects becomes less significant. However, on account of constraints having to do with such factors as the milling process, the stability of finely divided powder and the sintering conditions, the lower limit on the average grain size in sintered compacts achievable at present in sintered rare earth magnets is several microns, and at best about 2 microns.

As already noted, in the last stage of the sintering process, final densification proceeds in the sintered compact and growth of the crystal grains occurs. High densification is essential for enhancing the flux density of the magnet, but growth of the crystal grains must be prevented to maintain the coercivity. In prior-art rare earth magnets, a fixed amount of rare earth oxide has been present as inclusions, such as at triple junctions on grain boundaries. By pinning the grain boundary migration that accompanies crystal growth, this rare earth oxide has made it possible to suppress grain boundary migration (i.e., growth of the crystal grains) while allowing densification of the sintered compact to proceed.

However, in high-performance rare earth magnets which have a low rare earth content and for which oxidation during production has been suppressed, too little rare earth oxide is present to achieve a sufficient pinning effect. As a result, certain crystal grains rapidly grow in size at the sintering temperature, leading to the formation of giant, abnormally grown grains. Electron micrographs of such grains are shown in FIGS. 20(*a*) and (*b*). In some of the crystal grains that grow abnormally in this way, growth occurs in the original direction of orientation, while in others growth occurs in a different direction.

Magnetic domains due to an anchoring effect are apparent in FIGS. 20(*a*) and (*b*). However, because the direction of the 180° domain wall differs for each abnormally grown grain, it is apparent that the orientation is disorderly. Crystal grains in which the orientation has not changed but which have become large in size have a lower coercivity, and crystal grains in which the orientation is disorderly as well have both a lower coercivity and a lower residual flux density. Hence, the hysteresis curve for the magnet has a poor squareness, resulting in inferior magnetic properties.

We have resolved these problems with high-performance magnet production by uniformly dispersing a compound selected from among zirconium-boron (Zr—B) compounds, niobium-boron (Nb—B) compounds and hafnium-boron (Hf—B) compounds as a major component at an average precipitated grain size of at most 5 $\mu$m and at a maximum interval between adjacently precipitated grains of the compound of at most 50 $\mu$m. That is, uniform dispersion of this type of Zr—B compound, Nb—B compound or Hf—B compound made it possible to very effectively suppress grain growth in the sintered compact. The grain boundary pinning effects of Zr—B compounds, Nb—B compounds and Hf—B compounds are at least as good as the effects of rare earth oxide, even at a small grain size of 5 $\mu$m or less. Hence, the uniform dispersion of such a compound so that the maximum interval between neighboring precipitated grains of the compound is 50 $\mu$m or less enables the compound to effectively suppress grain growth when used in a smaller amount than rare earth oxide. Such effects by Zr—B compounds, Nb—B compounds and Hf—B compounds enable the formation of giant, abnormally grown grains to be suppressed over a broad sintering temperature range, thus making it possible to hold the volumetric proportion for giant, $Fe_{14}R_2B_1$ phase, abnormally grown grains having a grain size of 100 $\mu$m or more to at most 3%, based on the overall metal microstructure.

Hence, the R—Fe—B base permanent magnet material of the present invention is composed of a rare earth-iron-boron magnetic alloy which contains a $Fe_{14}R_2B_1$ primary phase in a volumetric proportion of 87.5 to 97.5% by volume and a rare earth oxide or rare earth and transition metal oxide in a volumetric proportion of 0.1 to 3% by volume. The alloy has a metal microstructure containing as a major component a compound selected from among zirconium-boron compounds, niobium-boron compounds and hafnium-boron compounds, which compound has an average grain size of at most 5 $\mu$m and is uniformly distributed within the alloy such that the maximum interval between adjacently precipitated grains of the compound is at most 50 $\mu$m.

This rare-earth permanent magnet material contains preferably at most 3% by volume of giant, abnormally grown $Fe_{14}R_2B_1$ phase grains having a grain size of 100 $\mu$m or more, based on the overall metal microstructure.

The rare-earth permanent magnetic alloy of the invention has a composition by weight that preferably includes 27 to 33%, and especially 28.8 to 31.5%, of one or more rare earth element (R); 0.1 to 10%, and especially 1.3 to 3.4%, of cobalt; 0.9 to 1.5%, and especially 0.95 to 1.15%, of boron; 0.05 to 1.0%, and especially 0.1 to 0.5%, of aluminum; 0.02 to 1.0%, and especially 0.05 to 0.3%, of copper; 0.02 to 1.0%, and especially 0.05 to 0.3%, of an element selected from among zirconium, niobium and hafnium; 0.03 to 0.1%, and especially 0.04 to 0.07%, of carbon; 0.05 to 0.5%, and especially 0.08 to 0.4%, of oxygen; and 0.002 to 0.05%, and especially 0.005 to 0.03%, of nitrogen; with the balance being iron and inadvertent impurities.

As noted above, R is preferably at least one selected from the group consisting of Pr, Nd, Tb, Dy and Ho. More preferably, one of the rare-earth elements (R) is Nd (neodymium). The content of neodymium is preferably 15 to 33 wt %, and is more preferably 18 to 33 wt %. The alloy preferably has a rare-earth element content of 27 to 33 wt %. Less than 27 wt % of R may lead to an excessive decline in coercivity whereas more than 33 wt % of R may lead to an excessive decline in residual flux density.

In the practice of the invention, substituting some of the iron with cobalt is effective for improving the Curie temperature (Tc). However, at a cobalt content of less than 0.1 wt %, the Curie temperature improving effect is small. From the standpoint of cost, a cobalt content of 0.1 to 10 wt % is desirable.

At a boron content below 0.9 wt %, the decrease in coercivity may become excessive, whereas a boron content above 1.5 wt % of boron may result in an excessive decline in residual flux density. Hence, a boron content of 0.9 to 1.5 wt % is preferred.

Aluminum is effective for raising the coercivity without incurring additional cost. At less than 0.05 wt %, the increase in coercivity is very small, whereas the presence of more than 1.0 wt % of aluminum may result in a large decline in the residual flux density. Hence, an aluminum content of 0.05 to 1.0 wt % is preferred.

A copper content of from 0.02 to 1.0 wt % is advantageous. A less than 0.02 wt %, the coercivity increasing effect is negligible, whereas the presence of more than 1.0 wt % of copper may result in an excessive decrease in the residual flux density.

The element selected from among zirconium, niobium and hafnium, when added in combination with copper, expands the optimal sintering temperature range. In addition, of the magnetic properties, it helps increase the coercivity in particular. At less than 0.02 wt %, the coercivity increasing effect is negligible, but at more than 1.0 wt %, an excessive decrease in the residual flux density may result. Hence, a content of this element within a range of 0.02 to 1.0 wt % is preferred.

An oxygen content below 0.05 wt % tends to lead to excessive sintering, and ultimately a poor squareness ratio. On the other hand, at an oxygen content above 0.5 wt %, the presence of oxide elicits the same uniform Zr—B compound, Nb—B compound or Hf—B compound precipitating effects as the present invention. Hence, an oxygen content of 0.05 to 0.5 wt % is preferred.

At a carbon content of less than 0.03 wt %, excessive sintering tends to arise and the squareness ratio is often poor. On the other hand, at more than 0.1 wt %, the sinterability and squareness are often poor and the coercivity tends to decline. Hence, a carbon content of 0.03 to 0.1 wt % is desirable.

At a nitrogen content below 0.002 wt %, excessive sintering tends to arise and the squareness ratio is often poor. On the other hand, at above 0.05 wt %, the sinterability and squareness ratio are often poor and the coercivity tends to decline. Hence, a nitrogen content of 0.02 to 0.05 wt % is desirable.

The copper and the zirconium, niobium or hafnium used in the invention may be used as alloys or admixtures with the iron or aluminum employed as starting materials. The additional presence of a small amount of up to 0.2 wt % of lanthanum, cerium, samarium, nickel, manganese, silicon, calcium, magnesium, sulfur, phosphorus, tungsten, molybdenum, tantalum, chromium, gallium and titanium already present in the starting materials or admixed during the production processes does not compromise the effects of the invention.

The permanent magnet material of the invention can be produced by using materials such as those indicated in the subsequent examples to prepare an alloy according to a conventional process, then subjecting the alloy as needed to hydrogenation and semi-dehydrogenation, followed by pulverization, forming, sintering and heat treatment. Use can also be made of what is sometimes referred to as a "two alloy process."

According to the invention, by subjecting an R—Fe—B—Cu base system which contains a very small amount of zirconium, niobium or hafnium and has a composition within a fixed range to alloy casting, milling, pressing, sintering and also heat treatment at a temperature lower than the sintering temperature, the residual magnetic flux density (Br) can be increased somewhat and the coercivity (iHc) can be greatly increased, giving an excellent squareness ratio. Moreover, the optimal sintering temperature range can be broadened to from 20 to 60° C.

The permanent magnet materials of the invention can thus be endowed with excellent magnetic properties, including a residual flux density (Br) of at least 12.5 G, a coercivity (iHc) of at least 10 kOe, and a squareness ratio ($4\times(BH)_{max}/Br^2$) of at least 0.95. Note that $(BH)_{max}$ is the maximum energy product.

EXAMPLES

The following examples and comparative examples are provided to illustrate the invention, and are not intended to limit the scope thereof.

The volumetric proportion of the $Fe_{14}R_2B_1$ phase, the volumetric proportion of the rare earth oxide or rare earth and transition metal oxide, and the volumetric proportion of giant, abnormally grown grains of $Fe_{14}R_2B_1$ phase having a grain size of at least 100 μm in the rare-earth permanent magnet materials prepared in the examples and comparative examples are shown collectively in Table 13.

Example 1

The starting materials neodymium, praseodymium, dysprosium, electrolytic iron, cobalt, ferroboron, aluminum, copper and ferrozirconium were formulated to a composition, by weight, of 27Nd-2Pr-1Dy-balance Fe-3Co-1B-0.5Al-0.2Cu-XZr (where X is 0 or 0.2) so as to compare the effects of zirconium addition and non-addition, following which the respective alloys were prepared by a double roll quenching process. The alloys were then subjected to hydrogenation in a 1.0±0.2 kgf/cm$^2$ hydrogen atmosphere, following which dehydrogenation was carried out at 700° C. for a period of 5 hours in a $\leqq 10^{-2}$ torr vacuum. Each of the alloys obtained following hydrogenation and dehydrogenation was in the form of a coarse powder having a particle size of several hundred microns. The coarse powders were each mixed with a lubricant (0.08 wt % of oleic acid) in a twin shell mixer, and pulverized to an average particle size of about 3 μm under a stream of nitrogen in a jet mill. The resulting fine powders were filled into the die of a press, oriented in a 10 kOe magnetic field, and subjected to compaction under a pressure of 1.2 metric tons/cm$^2$ applied perpendicular to the magnetic field. The powder compacts thus obtained were sintered at temperatures of from 1,020 to 1,100° C. for 2 hours in argon, then cooled. After cooling, they were heat-treated at 500° C. for 1 hour in argon, yielding permanent magnet materials of the respective compositions. These R—Fe—B base permanent magnet materials had a carbon content of 0.031 to 0.043 wt %, a nitrogen content of 0.009 to 0.017 wt %, and an oxygen content of 0.105 to 0.186 wt %.

Figure 1:
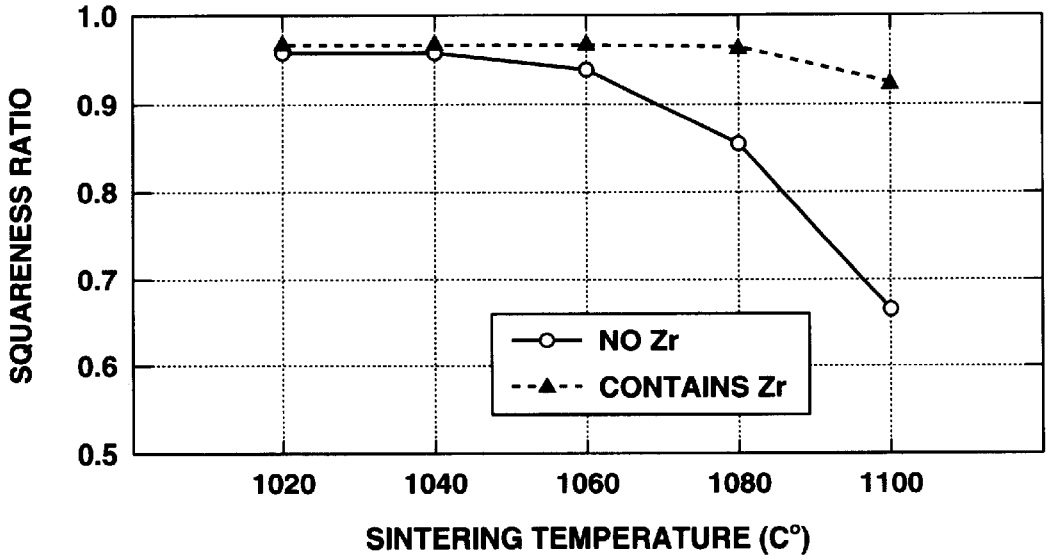
FIG. 1 is a graph of the sintering temperature versus squareness ratio for the zirconium-free magnet material and the zirconium-containing magnet material prepared in Example 1.
Figure 2:
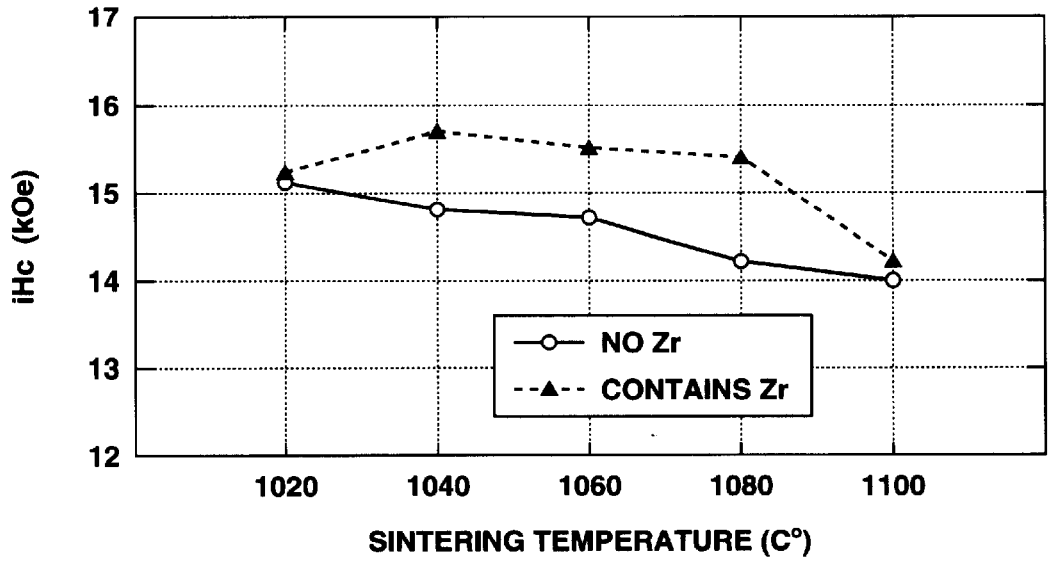
FIG. 2 is a graph of the sintering temperature versus coercivity for the zirconium-free magnet material and the zirconium-containing magnet material prepared in Example 1.
Figure 3:
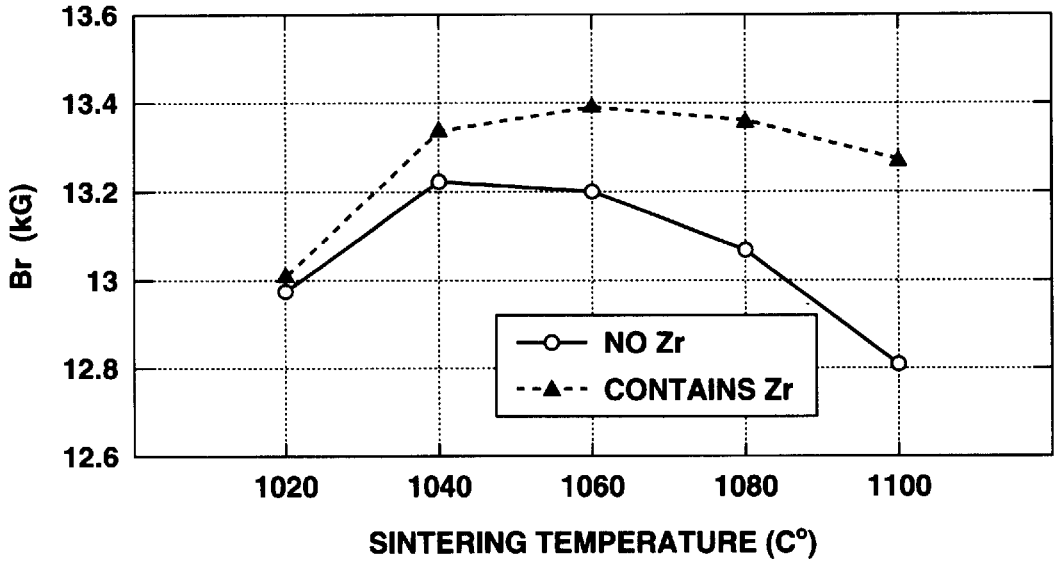
FIG. 3 is a graph of the sintering temperature versus residual flux density for the zirconium-free magnet material and the zirconium-containing magnet material prepared in Example 1.

The magnetic properties of the resulting magnet materials are shown in FIGS. 1 to 3. The relationship between the sintering temperature and the squareness ratio shown in FIG. 1 indicates that zirconium-free product (comparative example), when sintered at 1,020° C. and 1,040° C., had good squareness ratios of 0.954 and 0.955, respectively. However, the residual magnetic flux density (Br) of the zirconium-free product was 12.95 kG when sintered at 1,020° C., and was 13.24 kG when sintered at 1,040° C. Because the residual flux density for product sintered at 1,020° C. was unacceptably low, the only optimal sintering temperature for zirconium-free product was 1,040° C. Zirconium-containing product sintered at 1,040° C., 1,060° C. and 1,080° C. showed a good and substantially unchanged residual flux density (Br), coercivity (iHc) and squareness ratio, indicating an optimal sintering temperature range of 40° C. Moreover, at the optimal sintering temperatures, the zirconium-containing magnet material showed an increase in residual flux density of 100 G and an increase in coercivity of 1 kOe relative to the zirconium-free magnet material, indicating that zirconium addition is better than non-addition.

Figure 4A:
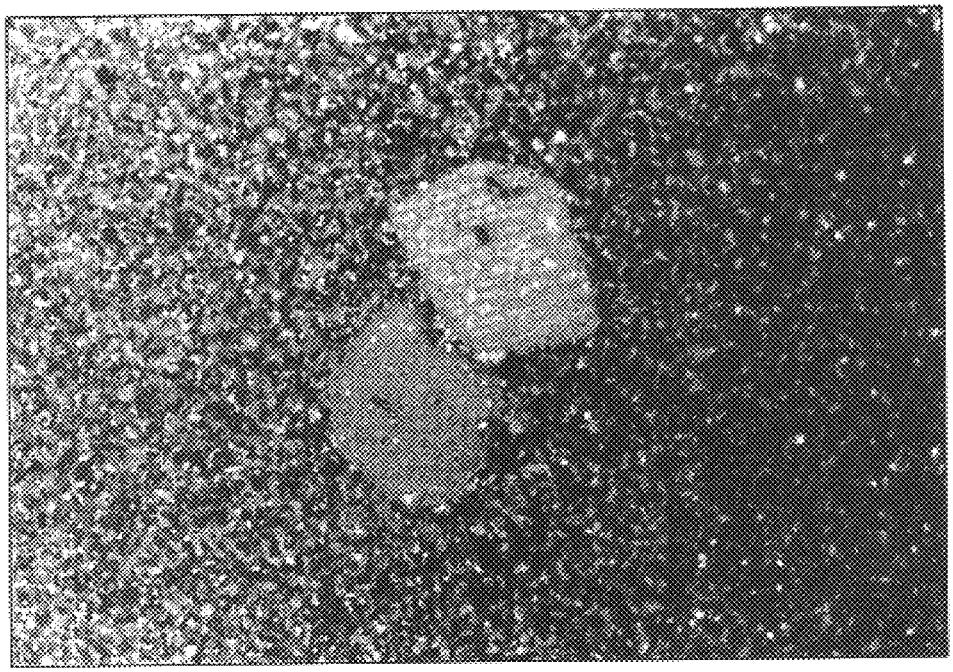
FIG. 4 shows polarizing microscope images of the zirconium-free magnet material (a) and the zirconium-containing magnet material (b) prepared in Example 1.
Figure 4B:
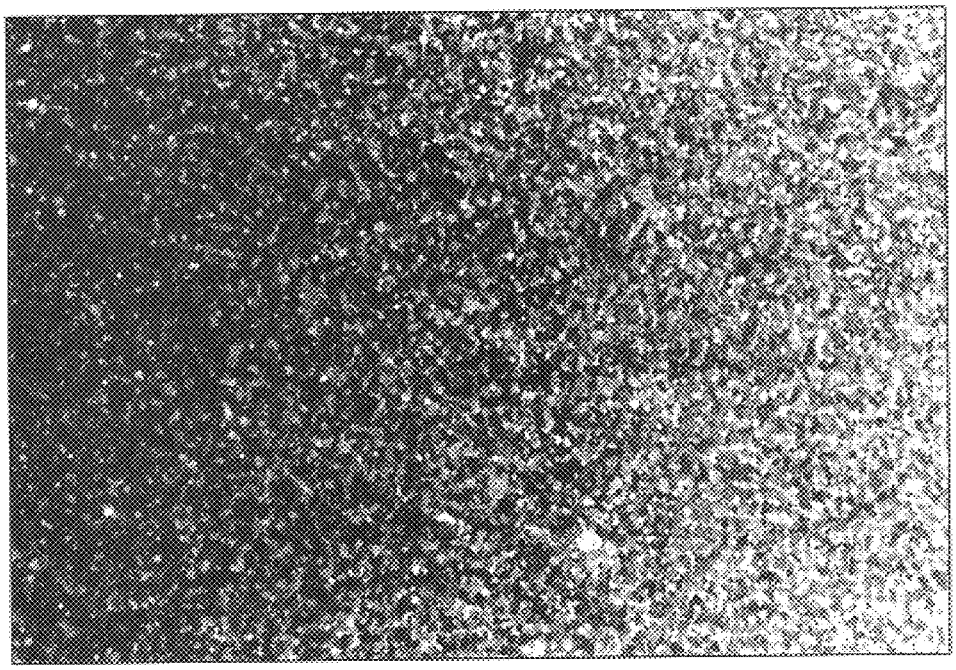

FIGS. 4(*a*) and (*b*) shows polarizing microscope images of the sintered compacts. In FIG. 4(*a*) of the zirconium-free product, areas of abnormal grain growth to about 500 μm are apparent in two places.

The element distribution patterns obtained with an electron probe microanalyzer (EPMA) showed that, in the zirconium-containing magnet material, the zirconium-boron compound having a grain size up to 5 μm was uniformly and finely precipitated at an interval of 50 μm or less. Quantitative analysis with an EPMA indicated that this zirconium-boron compound was mainly composed of Zr and B.

The foregoing results demonstrate that the addition of zirconium and the uniform and fine precipitation of a zirconium-boron compound within the sintered compact suppresses abnormal grain growth and broadens the optimal sintering temperature range.

Example 2

The starting materials neodymium, Tb (terbium), electrolytic iron, cobalt, ferroboron, aluminum, copper and ferrozirconium were formulated to a composition, by weight, of 30.0Nd-0.5Tb-balance Fe-1Co-1.1B-0.7Al-0.1Cu-XZr (where X is 0.01, 0.3 or 1.2) so as to compare the effects of different amounts of zirconium addition, following which the formulations were induction melted and cast in a water-cooled copper mold to give ingots of the respective compositions. The cast ingots were coarsely ground in a Brown mill, then processed under a stream of nitrogen in a jet mill to give fine powders having an average particle size of about 3 μm. The resulting powders were filled into the die of a press, oriented in a 15 kOe magnetic field, and subjected to compaction under a pressure of 0.7 metric ton/cm$^2$ applied perpendicular to the magnetic field. The powder compacts thus obtained were sintered at temperatures of from 1,020 to 1,100° C. for 2 hours in argon, then cooled. After cooling, they were heat-treated at 600° C. for 1 hour in argon, yielding permanent magnet materials of the respective compositions. These R—Fe—B base permanent magnet materials had a carbon content of 0.081 to 0.092 wt %, a nitrogen content of 0.003 to 0.010 wt %, and an oxygen content of 0.058 to 0.081 wt %.

Figure 5:
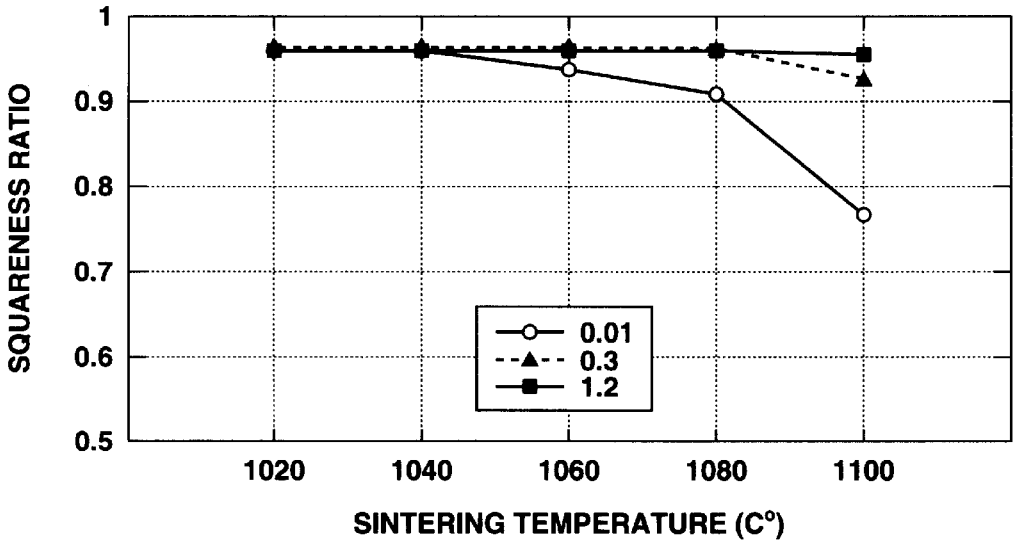
FIG. 5 is a graph of the sintering temperature versus squareness ratio for alloys of different zirconium contents prepared in Example 2.
Figure 6:
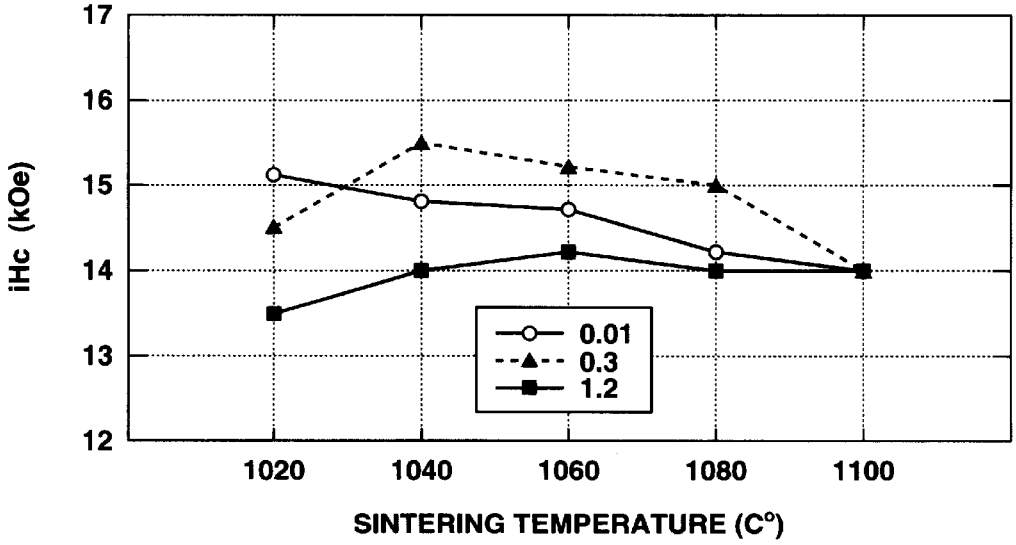
FIG. 6 is a graph of the sintering temperature versus coercivity for alloys of different zirconium contents prepared in Example 2.
Figure 7:
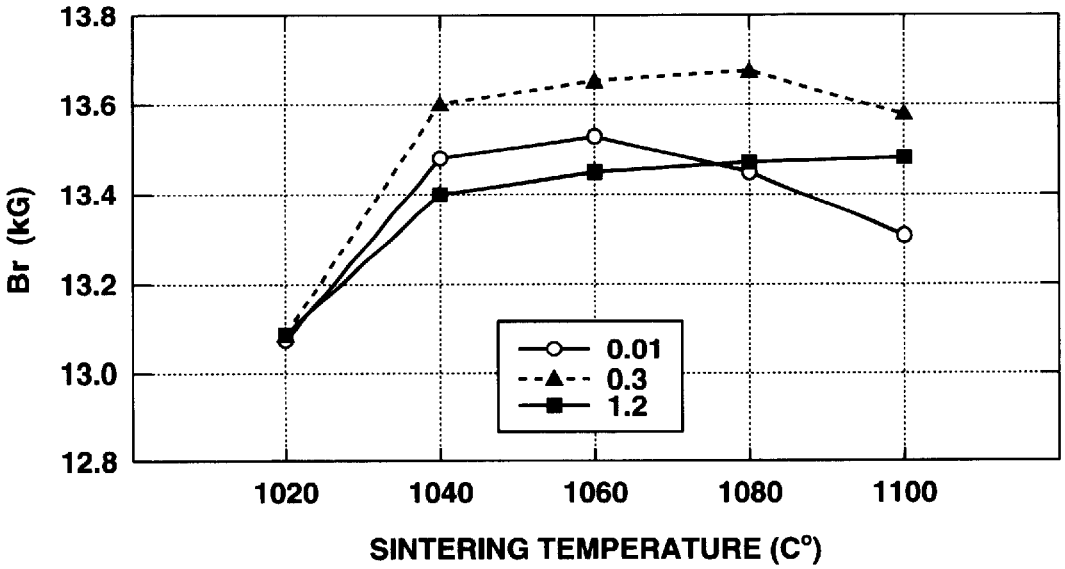
FIG. 7 is a graph of the sintering temperature versus residual flux density for alloys of different zirconium contents prepared in Example 2.

The magnetic properties of the resulting magnet materials are shown in FIGS. 5 to 7. The relationship between the sintering temperature and the squareness ratio shown in FIG. 5 indicates that the material having a zirconium content of 0.01 wt % (0.01 Zr product), when sintered at 1,020° C. and 1,040° C., had good squareness ratios of 0.956 and 0.955, respectively. However, the residual flux density (Br) was 13.07 kG when sintered at 1,020° C. and was 13.46 kG when sintered at 1,040° C., indicating that the residual flux density of the magnet material sintered at 1,020° C. tended to be somewhat inferior. By contrast, the 0.3 Zr product, when sintered at 1,040° C., 1,060° C. and 1,080° C., exhibited a good residual magnetic flux density, coercivity and squareness ratio that remained substantially unchanged. Hence, this product had an optimal sintering temperature range was 40° C. The 1.2 Zr product, when sintered at 1,040° C., 1,060° C. and 1,080° C., exhibited a residual magnetic flux density, coercivity and squareness ratio that remained substantially unchanged, indicating that it also had an optimal sintering temperature range of 40° C. However, because the 0.3 Zr product had a higher residual flux density of 13.60 to 13.66 kG and a higher coercivity of 15.0 to 15.5 kOe, it was clearly superior.

The element distribution patterns obtained with an EPMA showed that, in the 0.3 Zr product, zirconium-boron compound having a grain size up to 5 μm was uniformly and finely precipitated at intervals of 50 μm or less. In the 0.01 Zr product, zirconium-boron compound having a grain size of up to 5 μm precipitated at intervals of more than 50 μm and lacked the same degree of uniformity as the 0.3 Zr product. In the 1.2 Zr product, the zirconium-boron compound having a grain size up to 5 μm precipitated at an interval of 50 μm or less, but because the zirconium content was too high, the magnetic properties tended to be lower than those of the 0.3 Zr product. Quantitative analysis with an EPMA indicated that this zirconium-boron compound was mainly composed of Zr and B.

The foregoing results demonstrate that uniform and fine precipitation of a zirconium-boron compound with a grain size up to 5 μm within the sintered compact at an interval of not more than 50 μm suppresses abnormal grain growth and broadens the optimal sintering temperature range.

Example 3

In this example, attempts were made to achieve even higher magnetic properties by applying a two alloy process to the invention. The following experimental conditions were used in Examples 3-1, 3-2, 3-3 and 3-4 below, in which only the compositions of the mother alloy and the auxiliary alloy were varied. In each example, the mother alloy was fabricated by single roll quenching, then subjected to hydrogenation in a hydrogen atmosphere at 0.5 to 2.0 kgf/cm$^2$, followed by semi-dehydrogenation in a $\leqq 10^{-2}$ torr vacuum and at 500° C. for 3 hours. The auxiliary alloy was induction melted, then cast in a water-cooled copper mold, giving a cast ingot.

Next, 90 wt % of the mother alloy and 10 wt % of the auxiliary alloy were weighed out, 0.05 wt % of zinc stearate was added as a lubricant, and mixing was carried out in a twin shell mixer. The mixture was then pulverized in a jet mill under a nitrogen stream, giving a fine powder having an average particle size of about 4 μm. The resulting powders were filled into the die of a press, oriented in a 12 kOe magnetic field, and subjected to compaction under a pressure of 0.5 metric ton/cm$^2$ applied in a direction perpendicular to the magnetic field. The powder compacts thus obtained were sintered at temperatures ranging from 1,020° C. to 1,100° C. in 10° C. increments for 2 hours under a vacuum of $\leqq 10^{-4}$ torr, then cooled. After cooling, the sintered compacts were heat-treated at 500° C. for 1 hour under a vacuum of $\leqq 10^{-2}$ torr, yielding permanent magnet materials of the respective compositions.

Example 3-1

The mother alloy was formulated to a composition, by weight, of 30.0Nd-balance Fe-4.6Co-1.4B-0.2Al-XZr (where X is 0 or 0.5), and the auxiliary alloy was formulated to a composition of 36.0Nd-10.2Dy-balance Fe-25.8Co-0.2Al-2.4Cu. The overall composition after mixture was 29.7Nd-1.0Dy-balance Fe-6.7Co-1.2B-0.2Al-0.24Cu-XZr (where X is 0 or 0.45).

Example 3-2

The mother alloy was formulated to a composition, by weight, of 28.4Nd-balance Fe-1.9Co-1.3B-0.4Al-XZr (where X is 0 or 0.4), and the auxiliary alloy to a composition of 36.9Nd-10.2Tb-balance Fe-30.2Co-0.6B-0.3Al-3.2Cu. The overall composition after mixture was 29.3Nd-1.0Tb-balance Fe-4.7Co-1.2B-0.4Al-0.32Cu-XZr (where X is 0 or 0.39).

Example 3-3

The mother alloy was formulated to a composition, by weight, of 27.2Nd-balance Fe-0.9Co-1.0B-0.2Al, and the auxiliary alloy to a composition of 50.1Nd-9.4Dy-balance Fe-23.9Co-1.0B-0.2Al-1.1Cu-XZr (where X is 0 or 1.1). The overall composition after mixture was 29.5Nd-0.9Tb-balance Fe-3.2Co-1.0B-0.2Al-0.1Cu-XZr (where X is 0 or 0.11).

Example 3-4

The mother alloy was formulated to a composition, by weight, of 27.0Nd-1.0Dy-balance Fe-4.6Co-1.3B-0.4Al-XZr (where X is 0 or 0.45), and the auxiliary alloy to a composition of 35.5Nd-9.8Tb-balance Fe-29.0Co-0.3Al-2.3Cu-XZr (where X is 0 or 0.45). Mixture was carried out by combining a zirconium-free mother alloy with a zirconium-free auxiliary alloy, and by combining a zirconium-containing mother alloy with a zirconium-containing auxiliary alloy. The overall composition after mixture was 27.9Nd-2.3Dy-1.0Tb-balance Fe-7.0Co-1.1B-0.4Al-0.2Cu-XZr (where X is 0 or 0.45).

As is apparent from the results obtained, which are shown in Tables 1 to 4 below, in each of Examples 3-1 to 3-4, the zirconium-containing magnet material had a better residual magnetic flux density, coercivity and squareness ratio than the zirconium-free magnet material. Moreover, the results also demonstrated that the addition of zirconium expanded the optimal sintering temperature range.

TABLE 1

Example 3-1

| Zr content | Optimal sintering temperature range | Br | iHc | Squareness ratio |
|---|---|---|---|---|
| 0 | 1,050° C. only | 13.53 | 12.8 | 0.958 |
| 0.45 | 1,050–1,070° C. | 13.54–13.61 | 13.2–13.8 | 0.963–0.966 |

TABLE 2

| Example 3-2 | | | | |
|---|---|---|---|---|
| Zr content | Optimal sintering temperature range | Br | iHc | Squareness ratio |
| 0 | 1,060° C. only | 13.45 | 12.5 | 0.957 |
| 0.39 | 1,060–1,080° C. | 13.53–13.61 | 13.3–13.8 | 0.959–0.964 |

TABLE 3

| Example 3-3 | | | | |
|---|---|---|---|---|
| Zr content | Optimal sintering temperature range | Br | iHc | Squareness ratio |
| 0 | 1,060° C. only | 13.58 | 13.1 | 0.956 |
| 0.11 | 1,060–1,080° C. | 13.61–13.66 | 13.7–14.1 | 0.961–0.963 |

TABLE 4

| Example 3-4 | | | | |
|---|---|---|---|---|
| Zr content | Optimal sintering temperature range | Br | iHc | Squareness ratio |
| 0 | 1,080° C. only | 12.88 | 16.9 | 0.956 |
| 0.45 | 1,080–1,100° C. | 12.92–13.02 | 17.1–17.7 | 0.961–0.963 |

The element distribution patterns obtained with an EPMA showed that, in the zirconium-containing products in each of Examples 3-1 to 3–4, zirconium-boron compound having a grain size up to 5 μm was uniformly and finely precipitated at an interval of 50 μm or less. Quantitative analysis with an EPMA indicated that this zirconium-boron compound was mainly composed of Zr and B.

These results demonstrate that, in a two alloy process as well, the addition of zirconium and the uniform and fine precipitation of a zirconium-boron compound within the sintered compact has the effect of suppressing abnormal grain growth and broadening the optimal sintering temperature range.

Example 4

The starting materials neodymium, praseodymium, dysprosium, electrolytic iron, cobalt, ferroboron, aluminum, copper and ferroniobium were formulated to a composition, by weight, of 26.5Nd-2.2Pr-2.5Dy-balance Fe-4.5Co-1.1B-0.4Al-0.5Cu-XNb (where X is 0 or 0.2) so as to compare the effects of niobium addition and non-addition, following which the respective alloys were prepared by a double roll quenching process. The alloys were subjected to hydrogenation in a 1.5±0.3 kgf/cm$^2$ hydrogen atmosphere, following which dehydrogenation was carried out at 800° C. for a period of 5 hours in a $\leqq 10^{-2}$ torr vacuum. Each of the alloys obtained following hydrogenation and dehydrogenation treatment was in the form of a coarse powder having a particle size of several hundred microns. The coarse powders were each mixed with a lubricant (0.05 wt % of zinc stearate) in a twin shell mixer, and pulverized to an average particle size of about 3 μm under a stream of nitrogen in a jet mill. The resulting fine powders were filled into the die of a press, oriented in a 15 kOe magnetic field, and subjected to compaction under a pressure of 0.5 metric ton/cm$^2$ applied perpendicular to the magnetic field. The powder compacts thus obtained were sintered at temperatures of from 1,000 to 1,080° C. for 2 hours in argon, then cooled. After cooling, they were heat-treated at 500° C. for 1 hour in argon, yielding permanent magnet materials of the respective compositions. These R—Fe—B base permanent magnet materials had a carbon content of 0.061 to 0.073 wt %, a nitrogen content of 0.019 to 0.027 wt %, and an oxygen content of 0.095 to 0.116 wt %.

Figure 8:
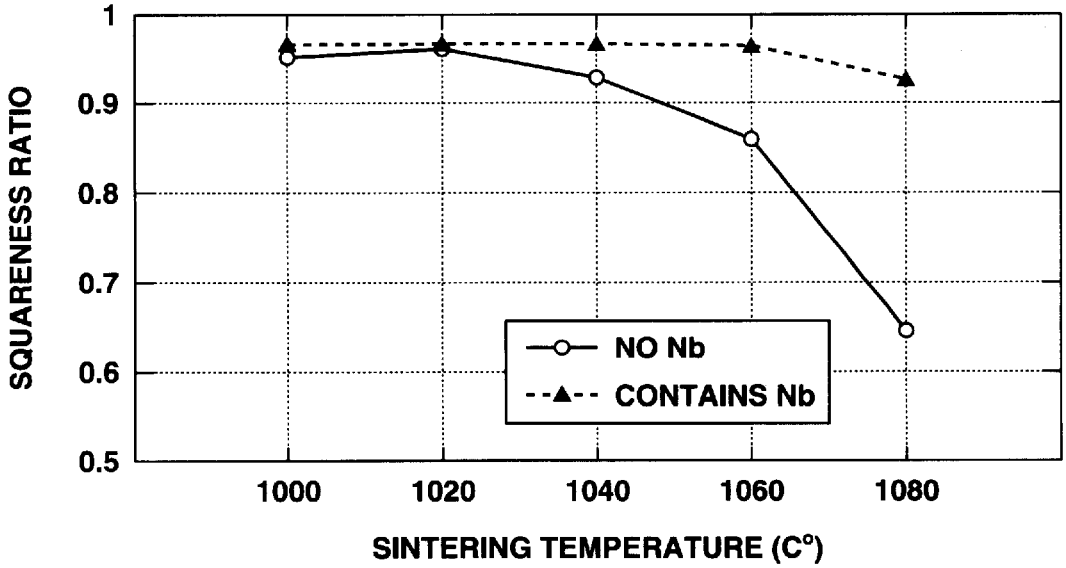
FIG. 8 is a graph of the sintering temperature versus squareness ratio for the niobium-free magnet material and the niobium-containing magnet material prepared in Example 4.
Figure 9:
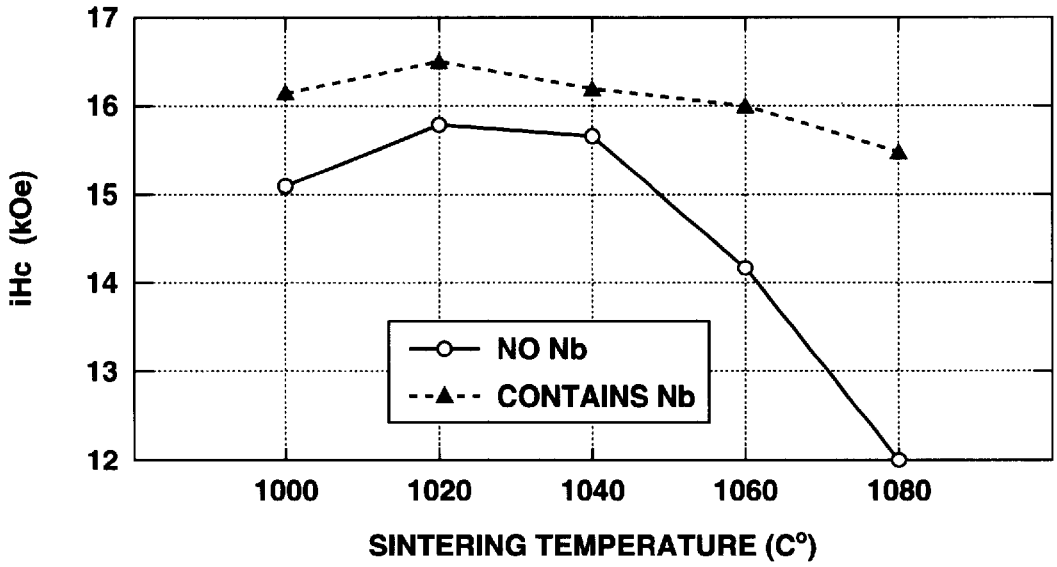
FIG. 9 is a graph of the sintering temperature versus coercivity for the niobium-free magnet material and the niobium-containing magnet material prepared in Example 4.
Figure 10:
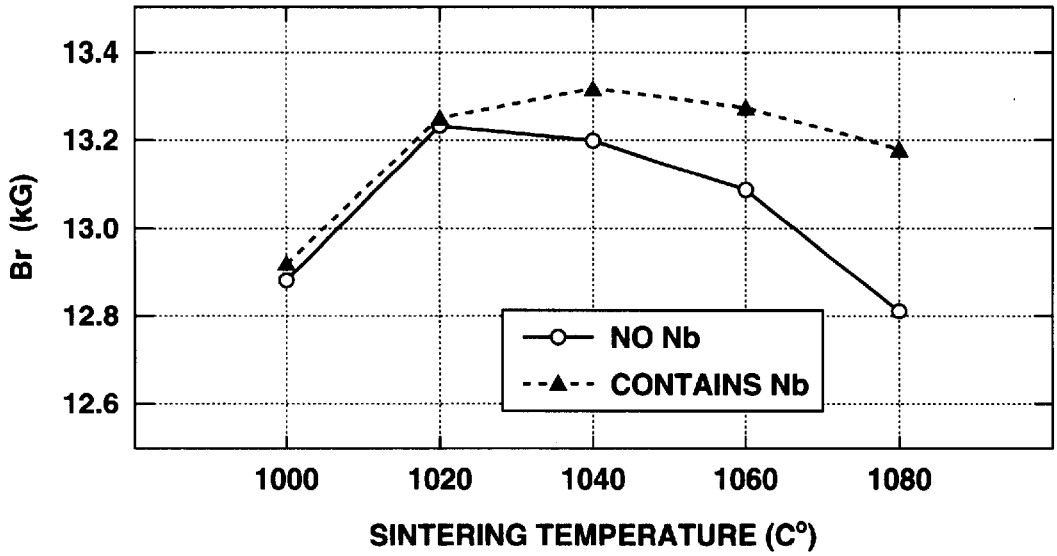
FIG. 10 is a graph of the sintering temperature versus residual flux density for the niobium-free magnet material and the niobium-containing magnet material prepared in Example 4.

The magnetic properties of the resulting magnet materials are shown in FIGS. 8 to 10. The relationship between the sintering temperature and the squareness ratio shown in FIG. 8 indicates that niobium-free product (comparative example), when sintered at 1,000° C. and 1,020° C., had good squareness ratios of 0.951 and 0.955, respectively. However, the residual magnetic flux density (Br) of the niobium-free product was 12.87 kG when sintered at 1,000° C., and was 13.23 kG when sintered at 1,020° C. Because the residual flux density for product sintered at 1,000° C. was unacceptably low, the only optimal sintering temperature for niobium-free product was 1,020° C. Niobium-containing product sintered at 1,020° C., 1,040° C. and 1,060° C. showed a good and substantially unchanged residual flux density, coercivity (iHc) and squareness ratio, indicating an optimal sintering temperature range of 40° C. Moreover, at the optimal sintering temperatures, the niobium-containing magnet material showed an increase in residual flux density of 80 G and an increase in coercivity of 500 Oe relative to the niobium-free magnet material, indicating that niobium addition is better than non-addition.

Abnormal grain growth to about 500 μm was observed in polarizing microscope images of sintered compacts prepared from the niobium-free alloy.

The element distribution patterns obtained with an EPMA showed that, in the niobium-containing magnet material, the niobium-boron compound having a grain size up to 5 μm was uniformly and finely precipitated at an interval of 50 μm or less. Quantitative analysis with an EPMA indicated that this niobium-boron compound was mainly composed of Nb and B.

The foregoing results demonstrate that the addition of niobium and the uniform and fine precipitation of a niobium-boron compound within the sintered compact suppresses abnormal grain growth and broadens the optimal sintering temperature range.

Example 5

The starting materials neodymium, Tb, electrolytic iron, cobalt, ferroboron, aluminum, copper and ferroniobium were formulated to a composition, by weight, of 29.1Nd-0.2Tb-balance Fe-2.7Co-1.2B-0.4Al-0.5Cu-XNb (where X is 0.01, 0.57 or 1.15) so as to compare the effects of different amounts of niobium addition, following which the formulations were induction melted and cast in a water-cooled copper mold to give ingots of the respective compositions. The cast ingots were coarsely ground in a Brown mill, then processed under a stream of nitrogen in a jet mill to give fine powders having an average particle size of about 5 μm. The resulting powders were filled into the die of a press, oriented in a 12 kOe magnetic field, and subjected to compaction under a pressure of 1.2 metric tons/cm$^2$ applied perpendicular to the magnetic field. The powder compacts thus obtained were sintered at temperatures of from 1,000 to 1,080° C. for 2 hours in a $\leqq 10^{-4}$ torr vacuum, then cooled. After cooling, they were heat-treated at 500° C. for 1 hour in a $\leqq 10^{-2}$ torr vacuum, yielding permanent magnet materials of the respective compositions. These R—Fe—B base permanent magnet materials had a carbon content of 0.030 to 0.038 wt %, a nitrogen content of 0.027 to 0.041 wt %, and an oxygen content of 0.328 to 0.418 wt %.

Figure 11:
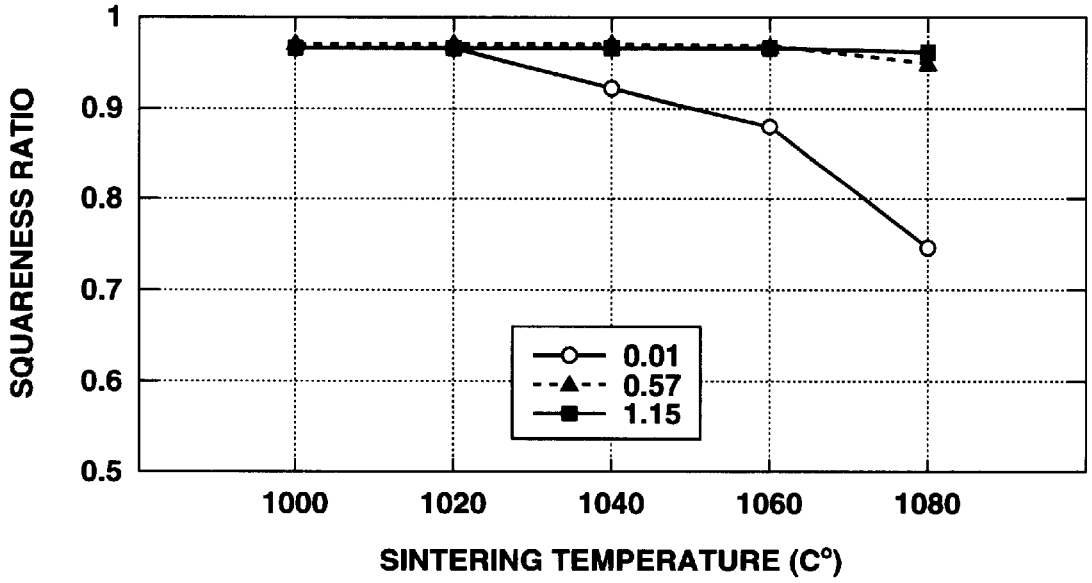
FIG. 11 is a graph of the sintering temperature versus squareness ratio for alloys of different niobium contents prepared in Example 5.
Figure 12:
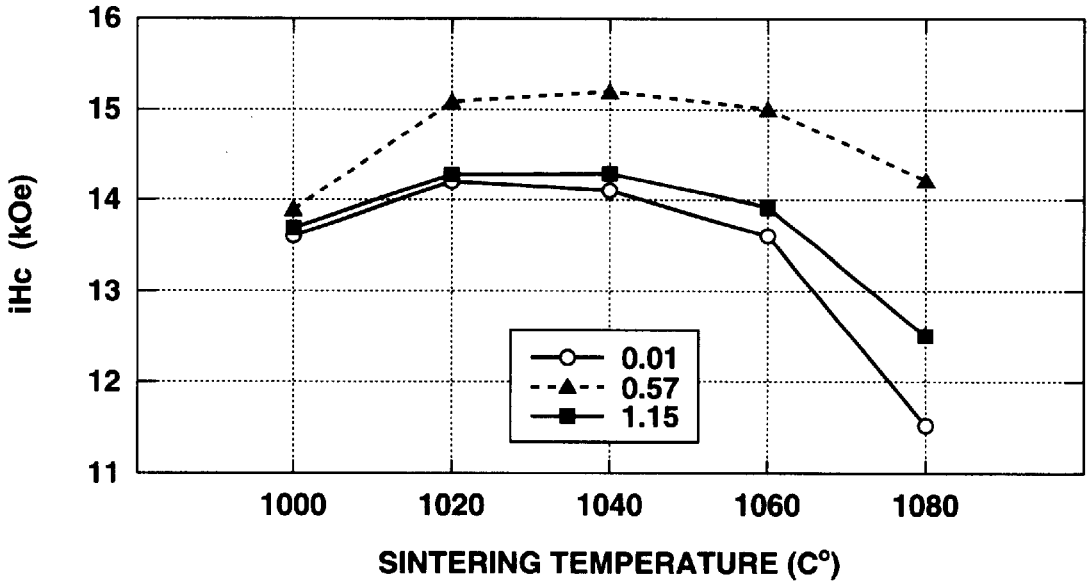
FIG. 12 is a graph of the sintering temperature versus coercivity for alloys of different niobium contents prepared in Example 5.
Figure 13:
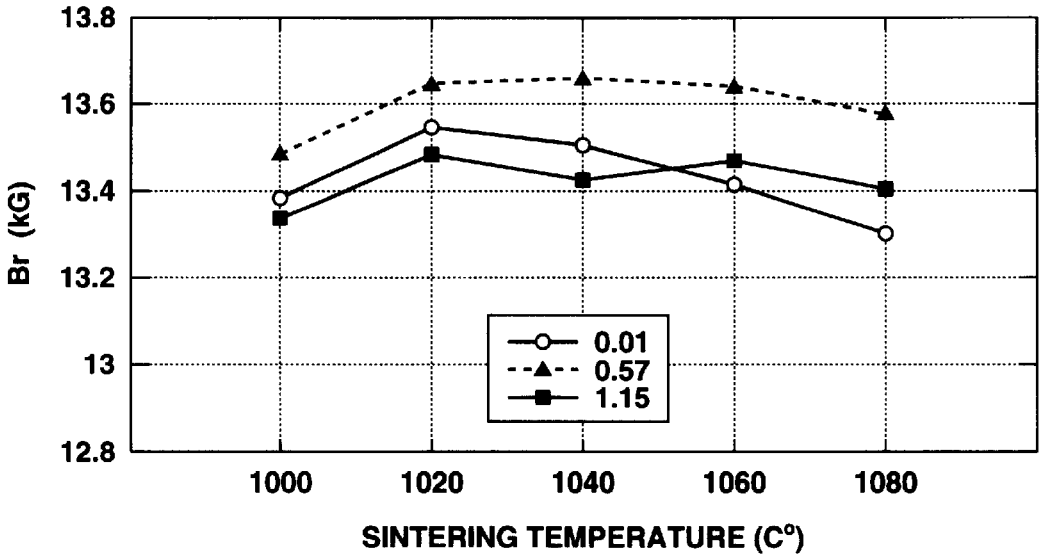
FIG. 13 is a graph of the sintering temperature versus residual flux density for alloys of different niobium contents prepared in Example 5.

The magnetic properties of the resulting magnet materials are shown in FIGS. 11 to 13. The relationship between the sintering temperature and the squareness ratio shown in FIG. 11 indicates that the material having a niobium content of 0.01 wt % (0.01 Nb product), when sintered at 1,000° C. and 1,020° C., had good squareness ratios of 0.951 and 0.953, respectively. However, the residual magnetic flux density was 13.37 kG when sintered at 1,000° C. and was 13.55 kG when sintered at 1,020° C., indicating that the residual flux density of the magnet material sintered at 1,000° C. tended to be somewhat inferior. By contrast, the 0.57 Nb product, when sintered at 1,020° C., 1,040° C. and 1,060° C., exhibited a good residual magnetic flux density, coercivity and squareness ratio that remained substantially unchanged. Hence, this product had an optimal sintering temperature range of 40° C. The 1.15 Nb product, when sintered at 1,020° C., 1,040° C. and 1,060° C., exhibited a residual magnetic flux density, coercivity and squareness ratio that remained substantially unchanged, indicating that it also had an optimal sintering temperature range of 40° C. However, because the product containing 0.57 Nb had a higher residual flux density of 13.65 to 13.67 kG and a higher coercivity of 14.9 to 15.2 kOe, it was clearly superior.

The element distribution patterns obtained with an EPMA showed that, in the 0.57 Nb product, niobium-boron compound having a grain size up to 5 μm was uniformly and finely precipitated at an interval of 50 μm or less. In the 1.15 Nb product, the niobium-boron compound having a grain size up to 5 μm was precipitated at an interval of 50 μm or less, but because the niobium content was too high, the magnetic properties tended to be lower than those for the 0.57 Nb product. Quantitative analysis with an EPMA indicated that this niobium-boron compound was mainly composed of Nb and B.

The foregoing results demonstrate that uniform and fine precipitation of a niobium-boron compound with a grain size up to 5 μm within the sintered compact at an interval of not more than 50 μm suppresses abnormal grain growth and broadens the optimal sintering temperature range.

Example 6

In this example, attempts were made to achieve even higher magnetic properties by applying a two alloy process to the invention. The following experimental conditions were used in Examples 6-1, 6-2, 6-3 and 6-4 below, in which only the compositions of the mother alloy and the auxiliary alloy were varied. In each example, the mother alloy was fabricated by single roll quenching, then subjected to hydrogenation in a hydrogen atmosphere at 0.5 to 2.0 kgf/cm$^2$, followed by semi-dehydrogenation in a $\leqq 10^{-2}$ torr vacuum and at 500° C. for 3 hours. The auxiliary alloy was induction melted, then cast in a water-cooled copper mold, giving a cast ingot.

Next, 92 wt % of the mother alloy and 8 wt % of the auxiliary alloy were weighed out, 0.05 wt % of the zinc stearate was added as a lubricant, and mixing was carried out in a twin shell mixer. The mixture was then pulverized in a jet mill under a nitrogen stream, giving a fine powder having an average particle size of about 4 μm. The resulting powders were filled into the die of a press, oriented in a 12 kOe magnetic field, and subjected to compaction under a pressure of 0.5 metric ton/cm$^2$ applied in a direction perpendicular to the magnetic field. The powder compacts thus obtained were sintered at temperatures ranging from 1,020° C. to 1,100° C. in 10° C. increments for 2 hours under a vacuum of $\leqq 10^{-4}$ torr, then cooled. After cooling, the sintered compacts were heat-treated at 500° C. for 1 hour in an argon atmosphere at $\leqq 10^{-2}$ torr, yielding permanent magnet materials of the respective compositions.

Example 6-1

The mother alloy was formulated to a composition, by weight, of 27.9Nd-balance Fe-7.3Co-1.3B-0.2Al-XNb (where X is 0 or 0.4), and the auxiliary alloy was formulated to a composition of 36.0Nd-10.2Dy-balance Fe-25.8Co-0.2Al-2.4Cu. The overall composition after mixture was 28.6Nd-3.1Dy-balance Fe-8.8Co-1.2B-0.2Al-0.2Cu-XNb (where X is 0 or 0.4).

Example 6-2

The mother alloy was formulated to a composition, by weight, of 28.1Nd-1.2Tb-balance Fe-3.7Co-1.2B-0.4Al-XNb (where X is 0 or 0.7), and the auxiliary alloy was formulated to a composition of 36.9Nd-10.2Tb-balance Fe-30.2Co-0.6B-0.3Al-3Cu. The overall composition after mixture was 28.8Nd-2.0Tb-balance Fe-5.8Co-1.1B-0.4Al-0.3Cu-XNb (where X is 0 or 0.7).

Example 6-3

The mother alloy was formulated to a composition, by weight, of 27.2Nd-balance Fe-0.9Co-1.0B-0.2Al, and the auxiliary alloy to a composition of 47.2Nd-8.9Dy-8.7Tb-balance Fe-22.5Co-0.1Al-1.4Cu-XNb (where X is 0 or 1.0). The overall composition after mixture was 28.8Nd-0.7Dy-0.7Tb-balance Fe-2.7Co-1.0B-0.2Al-0.1Cu-XNb (where X is 0 or 0.1).

Example 6-4

The mother alloy was formulated to a composition, by weight, of 27.0Nd-2.5Dy-balance Fe-4.6Co-1.3B-0.4Al-XNb (where X is 0 or 0.4), and the auxiliary alloy to a composition of 35.5Nd-9.8Tb-balance Fe-29.0Co-0.3Al-2.3Cu-XNb (where X is 0 or 0.4). Mixture was carried out by combining a niobium-free mother alloy with a niobium-free auxiliary alloy, and by combining a niobium-containing mother alloy with a niobium-containing auxiliary alloy. The overall composition after mixture was 27.7Nd-2.3Dy-0.8Tb-balance Fe-6.6Co-1.2B-0.4Al-0.2Cu-XNb (where X is 0 or 0.4).

As is apparent from the results obtained, which are shown in Tables 5 to 8 below, in each of Examples 6-1 to 6-4, the niobium-containing magnet material had a better residual magnetic flux density, coercivity and squareness ratio than the niobium-free magnet material. Moreover, the results also demonstrated that the addition of niobium expanded the optimal sintering temperature range.

TABLE 5

Example 6-1

| Nb content | Optimal sintering temperature range | Br | iHc | Squareness ratio |
|---|---|---|---|---|
| 0 | 1,040° C. only | 13.24 | 15.8 | 0.952 |
| 0.4 | 1,040–1,080° C. | 13.28–13.33 | 16.6–16.8 | 0.961–0.965 |

TABLE 6

| Example 6-2 | | | | |
|---|---|---|---|---|
| Nb content | Optimal sintering temperature range | Br | iHc | Squareness ratio |
| 0 | 1,030° C. only | 13.46 | 15.5 | 0.954 |
| 0.7 | 1,030–1,070° C. | 13.54–13.61 | 16.3–16.8 | 0.965–0.969 |

TABLE 7

| Example 6-3 | | | | |
|---|---|---|---|---|
| Nb content | Optimal sintering temperature range | Br | iHc | Squareness ratio |
| 0 | 1,030° C. only | 13.58 | 15.1 | 0.951 |
| 0.1 | 1,030–1,070° C. | 13.61–13.66 | 15.9–16.5 | 0.961–0.967 |

TABLE 8

| Example 6-4 | | | | |
|---|---|---|---|---|
| Nb content | Optimal sintering temperature range | Br | iHc | Squareness ratio |
| 0 | 1,040° C. only | 13.56 | 14.8 | 0.959 |
| 0.4 | 1,040–1,080° C. | 13.65–13.72 | 15.5–16.1 | 0.967–0.970 |

The element distribution patterns obtained with an EPMA showed that, in the niobium-containing products in each of Examples 6-1 to 6-4, niobium-boron compound having a grain size up to 5 μm was uniformly and finely precipitated at an interval of 50 μm or less. Quantitative analysis with an EPMA indicated that this niobium-boron compound was mainly composed of Nb and B.

These results demonstrate that, in a two alloy process as well, the addition of niobium and the uniform and fine precipitation of a niobium-boron compound within the sintered compact has the effect of suppressing abnormal grain growth and broadening the optimal sintering temperature range.

Example 7

The starting materials neodymium, praseodymium, Tb, electrolytic iron, cobalt, ferroboron, aluminum, copper and ferrohafnium were formulated to a composition, by weight, of 28.5Nd-1.0Pr-0.5Tb-balance Fe-4.0Co-1.3B-0.4Al-0.5Cu-XHf (where X is 0 or 0.4) so as to compare the effects of hafnium addition and non-addition, following which the respective alloys were prepared by a double roll quenching process. The alloys were subjected to hydrogenation in a 2.0±0.5 kgf/cm$^2$ hydrogen atmosphere, following which dehydrogenation was carried out at 400° C. for a period of 3 hours in a $\leqq 10^{-2}$ torr vacuum. Each of the alloys obtained following hydrogenation and dehydrogenation treatment was in the form of a coarse powder having a particle size of several hundred microns. The coarse powders were each mixed with a lubricant (0.05 wt % of Surfynol) in a twin shell mixer, and pulverized to an average particle size of about 5 μm under a stream of nitrogen in a jet mill. The resulting fine powders were filled into the die of a press, oriented in a 12 kOe magnetic field, and subjected to compaction under a pressure of 1.0 metric ton/cm$^2$ applied perpendicular to the magnetic field. The powder compacts thus obtained were sintered at temperatures of from 1,000 to 1,080° C. for 2 hours in argon, then cooled. After cooling, they were heat-treated at 500° C. for 1 hour in argon, yielding permanent magnet materials of the respective compositions. These R—Fe—B base permanent magnet materials had a carbon content of 0.051 to 0.063 wt %, a nitrogen content of 0.029 to 0.037 wt %, and an oxygen content of 0.135 to 0.216 wt %.

Figure 14:
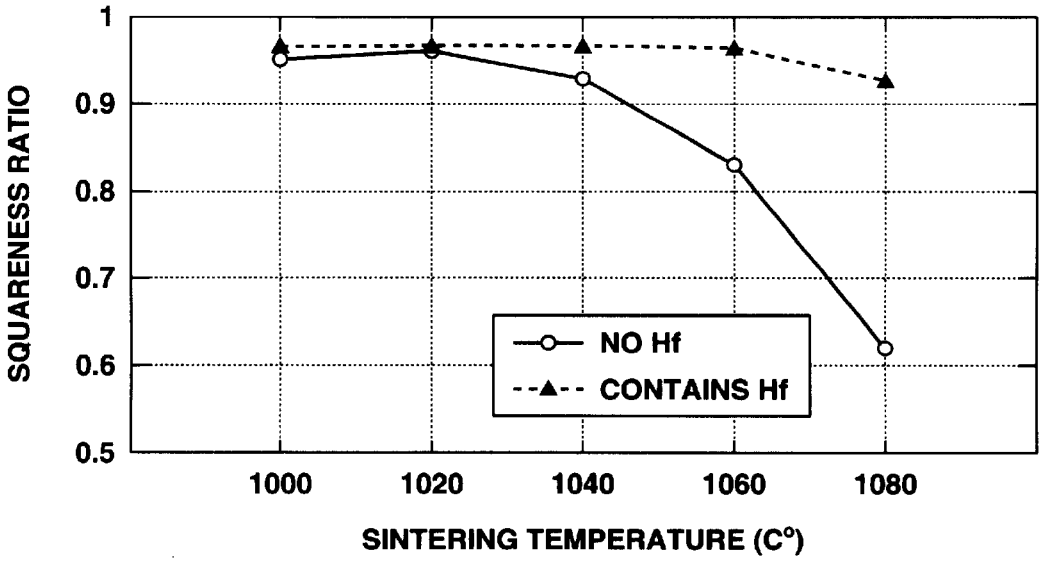
FIG. 14 is a graph of the sintering temperature versus squareness ratio for the hafnium-free magnet material and the hafnium-containing magnet material prepared in Example 7.
Figure 15:
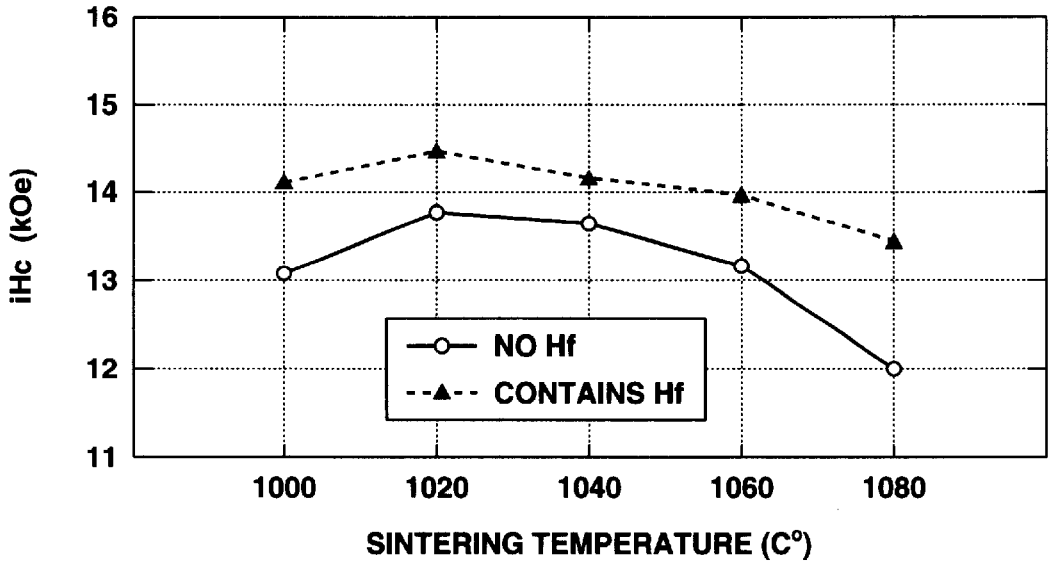
FIG. 15 is a graph of the sintering temperature versus coercivity for the hafnium-free magnet material and the hafnium-containing magnet material prepared in Example 7.
Figure 16:
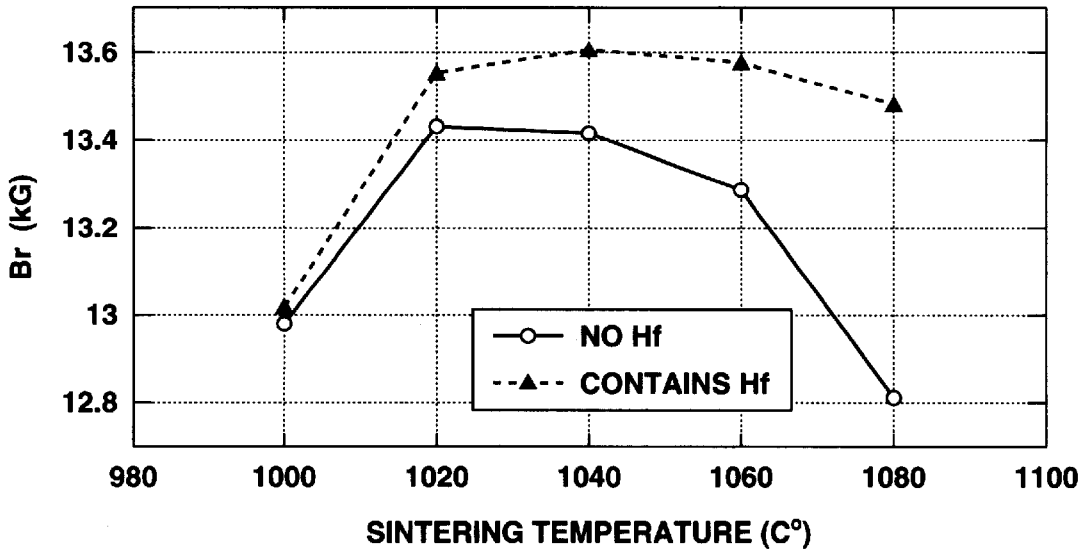
FIG. 16 is a graph of the sintering temperature versus residual flux density for the hafnium-free magnet material and the hafnium-containing magnet material prepared in Example 7.

The magnetic properties of the resulting magnet materials are shown in FIGS. 14 to 16. The relationship between the sintering temperature and the squareness ratio shown in FIG. 14 indicates that hafnium-free product (comparative example), when sintered at 1,000° C. and 1,020° C., had good squareness ratios of 0.951 and 0.955, respectively. However, the residual magnetic flux density (Br) of the zirconium-free product was 12.93 kG when sintered at 1,000° C., and was 13.43 kG when sintered at 1,020° C. Because the residual flux density for product sintered at 1,000° C. was unacceptably low, the only optimal sintering temperature for hafnium-free product was 1,020° C. Hafnium-containing product sintered at 1,020° C., 1,040° C. and 1,060° C. showed a good and substantially unchanged residual flux density, coercivity (iHc) and squareness ratio, indicating an optimal sintering temperature range of 40° C. Moreover, at the optimal sintering temperatures, the hafnium-containing magnet material showed an increase in residual flux density of 80 G and an increase in coercivity of 700 Oe relative to the hafnium-free magnet material, indicating that hafnium addition is better than non-addition.

Abnormal grain growth to about 500 μm was observed in polarizing microscope images of sintered compacts prepared from the hafnium-free alloy.

The element distribution patterns obtained with an EPMA showed that, in the hafnium-containing magnet material, the hafnium-boron compound having a grain size up to 5 μm was uniformly and finely precipitated at an interval of 50 μm or less. Quantitative analysis with an EPMA indicated that this hafnium-boron compound was mainly composed of Hf and B.

The foregoing results demonstrate that the addition of hafnium and the uniform and fine precipitation of a hafnium-boron compound within the sintered compact suppresses abnormal grain growth and broadens the optimal sintering temperature range.

Example 8

The starting materials neodymium, praseodymium, dysprosium, electrolytic iron, cobalt, ferroboron, aluminum, copper and ferrohafnium were formulated to a composition, by weight, of 28.7Nd-2.2Pr-1.2Dy-balance Fe-3.6Co-1.2B-0.4Al-0.5Cu-XHf (where X is 0.01, 0.41 or 1.22) so as to compare the effects of different amounts of hafnium addition, following which the respective compositions were induction melted and cast in a water-cooled copper mold to give ingots of the respective compositions. The cast ingots were coarsely ground in a Brown mill, then processed under a stream of nitrogen in a jet mill to give fine powders having an average particle size of about 5 μm. The resulting powders were filled into the die of a press, oriented in a 15 kOe magnetic field, and subjected to compaction under a pressure of 0.7 metric ton/cm$^2$ applied perpendicular to the magnetic field. The powder compacts thus obtained were sintered at temperatures of from 1,000 to 1,080° C. for 2 hours in an argon atmosphere, then cooled. After cooling, they were heat-treated at 600° C. for 1 hour in argon, yielding permanent magnet materials of the respective compositions. These R—Fe—B base permanent magnet materials had a carbon content of 0.031 to 0.041 wt %, a nitrogen content of 0.023 to 0.040 wt %, and an oxygen content of 0.228 to 0.411 wt %.

Figure 17:
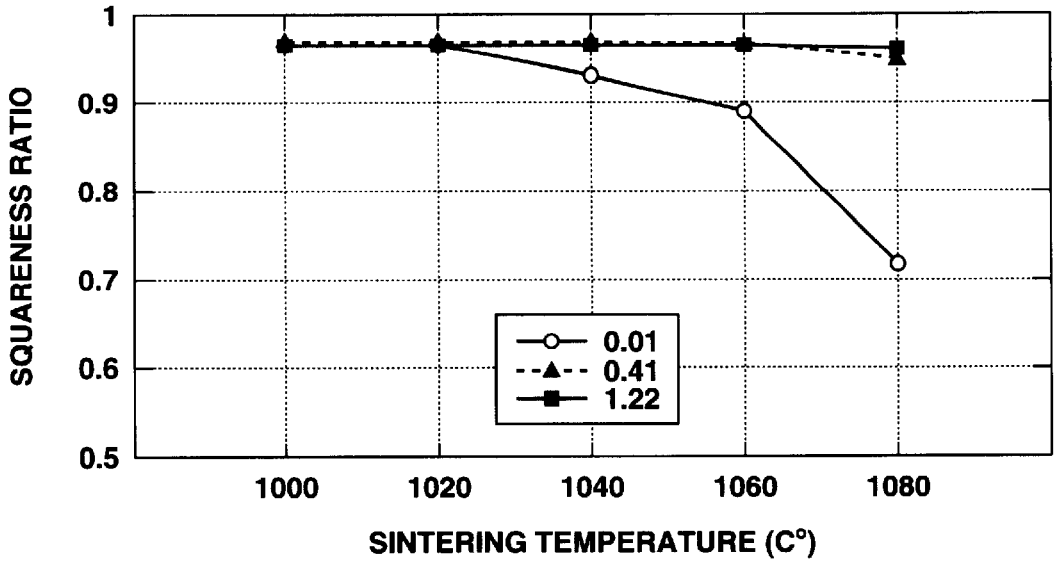
FIG. 17 is a graph of the sintering temperature versus squareness ratio for alloys of different hafnium contents prepared in Example 8.
Figure 18:
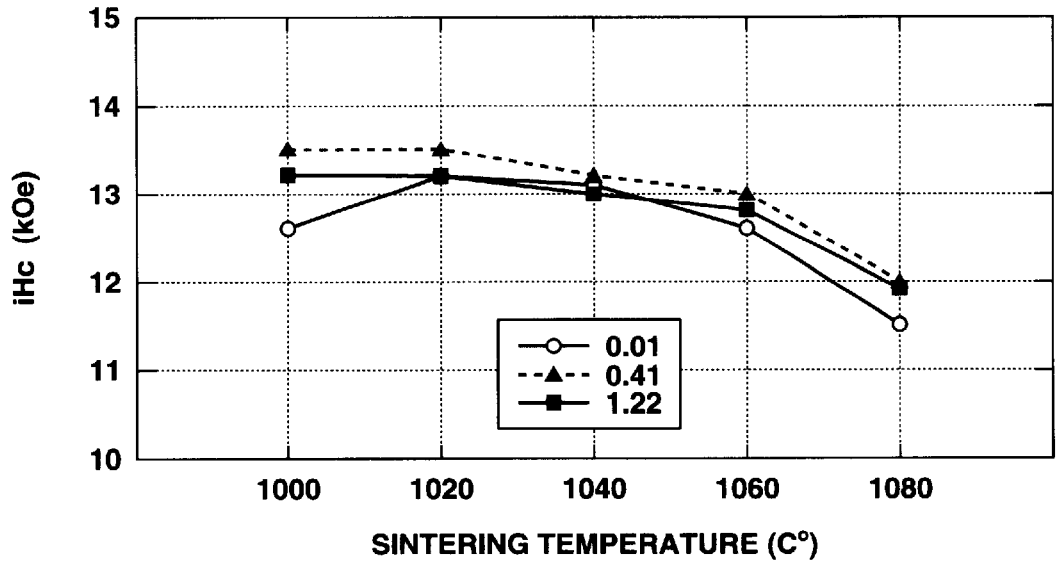
FIG. 18 is a graph of the sintering temperature versus coercivity for alloys of different hafnium contents prepared in Example 8.
Figure 19:
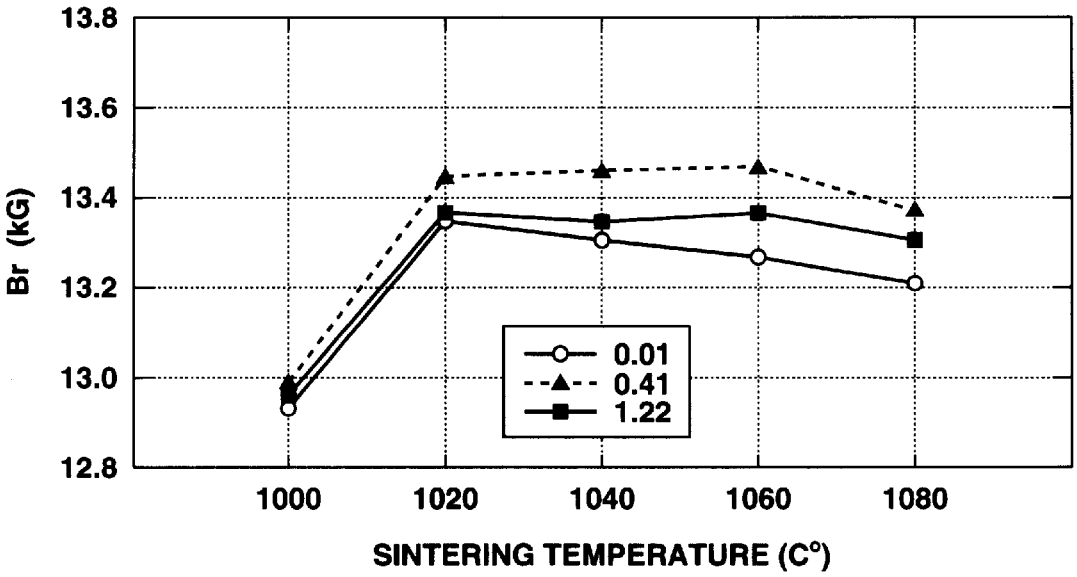
FIG. 19 is a graph of the sintering temperature versus residual flux density for alloys of different hafnium contents prepared in Example 8.

The magnetic properties of the resulting magnet materials are shown in FIGS. 17 to 19. The relationship between the sintering temperature and the squareness ratio shown in FIG. 17 indicates that the material having a hafnium content of 0.01 wt % (0.01 Hf product), when sintered at 1,000° C. and 1,020° C., had good squareness ratios of 0.951 and 0.953, respectively. However, the residual magnetic flux density was 12.93 kG when sintered at 1,000° C. and was 13.35 kG when sintered at 1,020° C., indicating that the residual flux density of the magnet material sintered at 1,000° C. tended to be somewhat inferior. By contrast, the 0.41 Hf product, when sintered at 1,020° C., 1,040° C. and 1,060° C., exhibited a good residual magnetic flux density, coercivity and squareness ratio that remained substantially unchanged. Hence, this product had an optimal sintering temperature range of 40° C. The 1.22 Hf product, when sintered at 1,020° C., 1,040° C. and 1,060° C., exhibited a residual magnetic flux density, coercivity and squareness ratio that remained substantially unchanged, indicating that it also had an optimal sintering temperature range of 40° C. However, because the product containing 0.41 Hf had a higher residual flux density of 13.45 to 13.47 kG and a higher coercivity of 13.2 to 13.5 kOe, it was clearly superior.

The element distribution patterns obtained with an EPMA showed that, in the 0.41 Hf product, hafnium-boron compound having a grain size up to 5 $\mu$m was uniformly and finely precipitated at an interval of 50 $\mu$m or less. In the 1.22 Hf product, the hafnium-boron compound having a grain size up to 5 $\mu$m was precipitated at an interval of 50 $\mu$m or less, but because the hafnium content was too high, the magnetic properties tended to be lower than those for the 0.41 Hf product. Quantitative analysis with an EPMA indicated that this hafnium-boron compound was mainly composed of Hf and B.

The foregoing results demonstrate that uniform and fine precipitation of a hafnium-boron compound with a grain size up to 5 $\mu$m within the sintered compact at an interval of not more than 50 $\mu$m suppresses abnormal grain growth and broadens the optimal sintering temperature range.

Example 9

In this example, attempts were made to achieve even higher magnetic properties by applying a two alloy process to the invention. The following experimental conditions were used in Examples 9-1, 9-2, 9-3 and 9-4 below, in which only the compositions of the mother alloy and the auxiliary alloy were varied. In each example, the mother alloy was fabricated by single roll quenching, then subjected to hydrogenation in a hydrogen atmosphere at 0.5 to 2.0 kgf/cm$^2$, followed by semi-dehydrogenation in a $\leqq 10^{-2}$ torr vacuum and at 500° C. for 3 hours. The auxiliary alloy was induction melted, then cast in a water-cooled copper mold, giving a cast ingot.

Next, 88 wt % of the mother alloy and 12 wt % of the auxiliary alloy were weighed out, 0.05 wt % of the zinc stearate was added as a lubricant, and mixing was carried out in a twin shell mixer. The mixture was then pulverized in a jet mill under a nitrogen stream, giving a fine powder having an average particle size of about 4 $\mu$m. The resulting powders were filled into the die of a press, oriented in a 12 kOe magnetic field, and subjected to compaction under a pressure of 0.5 metric ton/cm$^2$ applied in a direction perpendicular to the magnetic field. The powder compacts thus obtained were sintered at temperatures ranging from 1,020° C. to 1,100° C. in 10° C. increments for 2 hours under a $\leqq 10^{-4}$ torr vacuum, then cooled. After cooling, the sintered compacts were heat-treated at 500° C. for 1 hour in a $\leqq 10^{-2}$ torr vacuum, yielding permanent magnet materials of the respective compositions.

Example 9-1

The mother alloy was formulated to a composition, by weight, of 27.2Nd-balance Fe-0.9Co-1.0B-0.2Al, and the auxiliary alloy was formulated to a composition of 49.6Nd-9.3Dy-balance Fe-23.6Co-0.2Al-1.1Cu-XHf (where X is 0 or 0.2). The overall composition after mixture was 29.9Nd-1.1Dy-balance Fe-3.7Co-1.0B-0.2Al-0.1Cu-XHf (where X is 0 or 0.2).

Example 9-2

The mother alloy was formulated to a composition, by weight, of 28.0Nd-2.5Dy-balance Fe-4.6Co-1.3B-0.4Al, and the auxiliary alloy was formulated to a composition of 34.0Nd-9.4Tb-balance Fe-27.8Co-0.3Al-2.2Cu-XHf (where X is 0 or 8.4). The overall composition after mixture was 28.7Nd-2.2Dy-1.1Tb-balance Fe-7.4Co-1.1B-0.4Al-0.3Cu-XHf (where X is 0 or 1.0).

Example 9-3

The mother alloy was formulated to a composition, by weight, of 28.0Nd-1.3Dy-balance Fe-7.3Co-1.3B-0.2Al-0.5Cu-XHf (where X is 0 or 0.7), and the auxiliary alloy to a composition of 36.0Nd-10.2Dy-balance Fe-25.8Co-0.2Al-2.4Cu. The overall composition after mixture was 29.0Nd-2.3Dy-balance Fe-9.5Co-1.2B-0.2Al-0.7Cu-XHf (where X is 0 or 0.7).

Example 9-4

The mother alloy was formulated to a composition, by weight, of 27.0Nd-1.2Tb-balance Fe-3.7Co-1.2B-0.4Al-0.3Cu-XHf (where X is 0 or 0.7), and the auxiliary alloy to a composition of 36.9Nd-10.2Tb-balance Fe-30.2Co-0.3Al-3.3Cu-0.7 Hf. The overall composition after mixture was 28.2Nd-2.3Tb-balance Fe-6.9Co-1.1B-0.4Al-0.7Cu-XHf (where X is 0 or 0.7).

As is apparent from the results obtained, which are shown in Tables 9 to 12 below, in each of Examples 9-1 to 9-4, the hafnium-containing magnet material had a better residual magnetic flux density, coercivity and squareness ratio than the hafnium-free magnet material. Moreover, the results also demonstrated that the addition of hafnium expands the optimal sintering temperature range.

TABLE 9

Example 9-1

| Hf content | Optimal sintering temperature range | Br | iHc | Squareness ratio |
|---|---|---|---|---|
| 0 | 1,020° C. only | 13.43 | 14.8 | 0.955 |
| 0.2 | 1,020–1,060° C. | 13.48–13.59 | 15.2–15.8 | 0.961–0.965 |

TABLE 10

| Example 9-2 | | | | |
|---|---|---|---|---|
| Hf content | Optimal sintering temperature range | Br | iHc | Squareness ratio |
| 0 | 1,030° C. only | 12.85 | 17.5 | 0.952 |
| 1.0 | 1,030–1,070° C. | 12.91–13.01 | 18.3–18.8 | 0.962–0.964 |

TABLE 11

| Example 9-3 | | | | |
|---|---|---|---|---|
| Hf content | Optimal sintering temperature range | Br | iHc | Sguarenes ratio |
| 0 | 1,030° C. only | 13.18 | 16.1 | 0.956 |
| 0.7 | 1,030–1,070° C. | 13.31–13.36 | 16.7–17.1 | 0.964–0.968 |

TABLE 12

| Example 9-4 | | | | |
|---|---|---|---|---|
| Hf content | Optimal sintering temperature range | Br | iHc | Sguarenes ratio |
| 0 | 1,020° C. only | 13.16 | 16.8 | 0.951 |
| 0.7 | 1.020–1,060° C. | 13.25–13.32 | 17.5–18.1 | 0.966–0.969 |

The element distribution patterns obtained with an EPMA showed that, in the hafnium-containing products in each of Examples 9-1 to 9-4, a hafnium-boron compound having a grain size up to 5 $\mu$m was uniformly and finely precipitated at an interval of 50 $\mu$m or less. Quantitative analysis with an EPMA indicated that this hafnium-boron compound was mainly composed of Hf and B.

These results demonstrate that, in a two alloy process as well, the addition of hafnium and the uniform and fine precipitation of a hafnium-boron compound within the sintered compact has the effect of suppressing abnormal grain growth and broadening the optimal sintering temperature range.

In working the present invention, it can be effective to subject the auxiliary alloy to induction melting, casting in a water-cooled mold, and hydrogenation and semi-dehydrogenation treatment; it can be effective to fabricate the auxiliary alloy by a single-roll or double-roll quenching process, followed by hydrogenation and semi-dehydrogenation treatment; and it can be effective to fabricate the auxiliary alloy by a single-roll or double-roll quenching process, followed by coarse grinding in a suitable apparatus such as a Brown mill.

TABLE 13

| | Zr or Nb or Hf (%) | $Fe_{14}Nd_2B_1$ (wt %) | Oxides (wt %) | Abnormally grown grains (%) |
|---|---|---|---|---|
| Example 1 | Zr 0 (comp. ex.) | 93.2 | 2.2 | 3.9 |
| | Zr 2 | 93.1 | 2.1 | 0.5 |
| Example 2 | Zr 0.01 | 94.1 | 0.9 | 4.0 |
| | Zr 0.3 | 94.2 | 0.8 | 1.3 |
| | Zr 1.2 | 93.7 | 1.0 | 1.4 |
| Example 3-1 | Zr 0 (comp. ex.) | 95.0 | 1.1 | 4.1 |
| | Zr 0.45 | 95.0 | 1.0 | 0.5 |

TABLE 13-continued

| | Zr or Nb or Hf (%) | $Fe_{14}Nd_2B_1$ (wt %) | Oxides (wt %) | Abnormally grown grains (%) |
|---|---|---|---|---|
| Example 3-2 | Zr 0 (comp. ex.) | 94.3 | 0.6 | 5.2 |
| | Zr 0.39 | 94.4 | 0.5 | 1.3 |
| Example 3-3 | Zr 0 (comp. ex.) | 96.8 | 2.0 | 3.5 |
| | Zr 0.11 | 96.7 | 2.1 | 0.8 |
| Example 3-4 | Zr 0 (comp. ex.) | 89.1 | 0.2 | 3.9 |
| | Zr 0.45 | 89.2 | 0.1 | 2.0 |
| Example 4 | Nb 0 (comp. ex.) | 94.2 | 1.2 | 4.9 |
| | Nb 0.2 | 94.1 | 1.1 | 0.8 |
| Example 5 | Nb 0.01 | 91.1 | 1.9 | 5.0 |
| | Nb 0.57 | 91.2 | 1.8 | 1.7 |
| | Nb 1.15 | 90.2 | 2.0 | 1.7 |
| Example 6-1 | Nb 0 (comp. ex.) | 92.0 | 2.1 | 4.5 |
| | Nb 0.4 | 92.1 | 2.0 | 0.9 |
| Example 6-2 | Nb 0 (comp. ex.) | 94.7 | 0.4 | 5.1 |
| | Nb 0.7 | 94.6 | 0.3 | 1.0 |
| Example 6-3 | Nb 0 (comp. ex.) | 95.8 | 1.0 | 3.8 |
| | Nb 0.1 | 95.7 | 1.1 | 1.8 |
| Example 6-4 | Nb 0 (comp. ex.) | 88.1 | 1.2 | 3.5 |
| | Nb 0.4 | 88.2 | 1.1 | 1.0 |
| Example 7 | Hf 0 (comp. ex.) | 91.2 | 2.2 | 4.9 |
| | Hf 0.4 | 91.1 | 2.1 | 0.7 |
| Example 8 | Hf 0.01 | 94.8 | 1.9 | 5.0 |
| | Hf 0.41 | 94.9 | 1.8 | 0.3 |
| | Hf 1.22 | 94.0 | 2.0 | 0.4 |
| Example 9-1 | Hf 0 (comp. ex.) | 88.0 | 1.6 | 5.1 |
| | Hf 0.2 | 88.0 | 1.7 | 1.5 |
| Example 9-2 | Hf 0 (comp. ex.) | 91.3 | 2.6 | 4.2 |
| | Hf 1.0 | 91.4 | 2.5 | 1.1 |
| Example 9-3 | Hf 0 (comp. ex.) | 96.8 | 1.0 | 3.7 |
| | Hf 0.7 | 96.9 | 1.1 | 0.5 |
| Example 9-4 | Hf 0 (comp. ex.) | 90.1 | 0.3 | 3.3 |
| | Hf 0.7 | 90.0 | 0.4 | 1.0 |

As is apparent from the results obtained in the foregoing examples, the present invention provides R—Fe—B base rare-earth permanent magnet materials having excellent magnetic properties.

Japanese Patent Application No. 2000-176595 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A sintered rare earth magnet comprising a rare-earth-iron-boron magnet alloy which comprises one or more rare-earth elements, iron, cobalt, boron, aluminum, copper, an element selected from zirconium and hafnium, carbon, oxygen and nitrogen, and which contains a $Fe_{14}R_2B_1$ primary phase wherein R represents at least one rare earth element in a volumetric proportion of 87.5 to 97.5% and a rare earth oxide or a rare earth and transition metal oxide in a volumetric proportion of 0.1 to 3%; wherein the alloy has a metal microstructure containing as a major component a compound selected from the group consisting of zirconium-boron compounds and hafnium-boron compounds, which compound has an average grain size of at most 5 $\mu$m and is uniformly distributed within the alloy such that the maximum interval between neighboring grains of the compound is at most 50 $\mu$m.

2. A sintered rare earth magnet of claim 1 which contains giant, abnormally grown grains of the $Fe_{14}R_2B_1$ phase having a grain size of at least 100 $\mu$m in a volumetric proportion of at most 3%, based on the overall metal microstructure.

3. A sintered rare earth magnet of claim 1 which has a residual flux density (Br) of at least 12.5 G, a coercivity (iHc) of at least kOe, and a squareness ration ($4\times(BH)_{max}/Br^2$, where $(BH)_{max}$ is the maximum energy product) of at least 0.95.

4. A sintered rare earth magnet of claim 1, wherein the rare earth-iron-boron magnetic alloy comprises 27 to 30 wt % of one or more rare-earth element, including 15 to 33 wt % of neodymium; 0.1 to 10 wt % of cobalt; 0.9 to 1.5 wt % of boron; 0.05 to 1.0 wt % of aluminum; 0.02 to 1.0 wt % of copper; 0.02 to 1.0 wt % of an element selected from among zirconium and hafnium; 0.03 to 1.0 wt % of carbon; 0.05 to 0.5 wt % of oxygen; 0.002 to 0.05 wt % of nitrogen; and iron.

5. A sintered rare earth magnet of claim 1, wherein the rare earth-iron-boron magnetic alloy comprises 28.8 to 31.5 wt % of one or more rare-earth element, including 18 to 33 wt % of neodymium; 1.3 to 3.5 wt % of cobalt; 0.95 to 1.15 wt % of boron; 0.12 to 0.5 wt % of aluminum; 0.05 to 0.3 wt % of copper; 0.05 to 0.3 wt % of an element selected from among zirconium and hafnium; 0.04 to 0.07 wt % of carbon; 0.08 to 0.4 wt % of oxygen; 0.05 to 0.03 wt % of nitrogen; and iron.

6. A sintered rare earth magnet of claim 1, wherein the rare earth-iron-boron magnetic alloy comprises 27 to 30 wt % of one or more rare-earth element, including; 0.1 to 10 wt % of cobalt; 0.9 to 1.5 wt % of boron; 0.05 to 1.0 wt % of aluminum; 0.02 to 1.0 wt % of copper; 0.02 to 1.0 wt % of an element selected from among zirconium and hafnium; 0.03 to 1.0 wt % of carbon; 0.05 to 0.5 wt % of oxygen; 0.002 to 0.05 wt % of nitrogen; and iron.

7. A sintered rare earth magnet according to claim 1, wherein said rare earth-iron-boron magnet alloy contains 15–33 wt % neodymium.

8. A sintered rare earth magnet according to claim 1, wherein said rare earth-iron-boron magnet alloy contains 18–33 wt % neodymium.

9. A sintered rare earth magnet according to claim 1, wherein the rare earth iron-boron magnetic alloy contains 0.1 to 10 wt % cobalt.

10. A sintered rare earth magnet according to claim 1, wherein the rare earth iron-boron magnetic alloy contains 0.9 to 1.5 wt % boron.

11. A sintered rare earth magnet according to claim 1, wherein the rare earth iron-boron magnetic alloy contains 0.05 to 1.0 wt % aluminum.

12. A sintered rare earth magnet according to claim 1, wherein the rare earth iron-boron magnetic alloy contains 0.02 to 1.0 wt % copper.

13. A sintered rare earth magnet according to claim 1, wherein the rare earth iron-boron magnetic alloy contains 0.02 to 1.0 wt % of an element select from among zirconium and hafnium.

14. A sintered rare earth magnet according to claim 1, wherein the rare earth iron-boron magnetic alloy contains 0.05 to 0.5 wt % oxygen.

15. A sintered rare earth magnet according to claim 1, wherein the rare earth iron-boron magnetic alloy contains 0.03 to 0.1 wt % carbon.

16. A sintered rare earth magnet according to claim 1, wherein the rare earth iron-boron magnetic alloy contains 0.002 to 0.05 wt % nitrogen.

17. A sintered rare earth magnet according to claim 1, wherein the rare earth iron-boron magnetic alloy contains up to 0.2 wt % of lanthanum, cerium, samarium, nickel, manganese, silicon, calcium, magnesium, sulfur, phosphorus, tungsten, molybdenum, tantalum, chromium, gallium and titanium.

18. A sintered rare earth magnet according to claim 1, wherein said magnet is prepared by compacting powder within a magnetic field and sintering the compacted powder.

19. A sintered rare earth magnet according to claim 1, where said magnet is prepared by filling powder into the die of a press, orienting the material in a magnetic field, subjecting the powder to compaction under pressure, and sintering the compacted powder.

20. A sintered rare earth magnet comprising a rare-earth-iron-boron magnet alloy which comprises one or more rare-earth elements, iron, cobalt, boron, aluminum, copper, an element selected from zirconium and hafnium, and which contains a $Fe_{14}R_2B_1$ primary phase wherein R represents at least one rare earth element in a volumetric proportion of 87.5 to 97.5% and a rare earth oxide or a rare earth and transition metal oxide in a volumetric proportion of 0.1 to 3%; wherein the alloy has a metal microstructure containing as a major component a compound selected from the group consisting of zirconium-boron compounds and hafnium-boron compounds, which compound has an average grain size of at most 5 $\mu$m and is uniformly distributed within the alloy such that the maximum interval between neighboring grains of the compound is at most 50 $\mu$m.

* * * * *